US009903694B2

(12) United States Patent
Palo

(10) Patent No.: US 9,903,694 B2
(45) Date of Patent: Feb. 27, 2018

(54) SELECTIVELY DISABLED AMMUNITION AND REMOTE AMMUNITION DISABLING SYSTEM AND METHOD OF USE

(71) Applicant: JD Pharma, LLC, New Canaan, CT (US)

(72) Inventor: Joseph Dan Palo, New Canaan, CT (US)

(73) Assignee: JD Pharma, LLC, New Canaan, CT (US)

( * ) Notice: Subject to any disclaimer, the term of this patent is extended or adjusted under 35 U.S.C. 154(b) by 0 days.

(21) Appl. No.: 15/456,510

(22) Filed: Mar. 11, 2017

(65) Prior Publication Data

US 2017/0261298 A1 Sep. 14, 2017

Related U.S. Application Data

(60) Provisional application No. 62/307,977, filed on Mar. 14, 2016.

(51) Int. Cl.
*F41A 17/08* (2006.01)
*F42B 5/02* (2006.01)
(Continued)

(52) U.S. Cl.
CPC ..... *F42C 15/00* (2013.01); *F42C 15/42* (2013.01); *F42C 19/04* (2013.01);
(Continued)

(58) Field of Classification Search
CPC ..... F41A 17/08; F41A 19/57; F42C 13/003; F42C 13/04; F42C 13/042; F42C 13/045;
(Continued)

(56) References Cited

U.S. PATENT DOCUMENTS 3,738,276 A * 6/1973 Picard ..... B65D 81/18 102/221
4,527,481 A * 7/1985 Evans ..... C06C 7/00 102/204

(Continued)

OTHER PUBLICATIONS

International Search Report and Written Opinion of the ISA, dated May 26, 2017.

(Continued)

*Primary Examiner* — Derrick R Morgan
(74) *Attorney, Agent, or Firm* — Entralta P.C.; Justin G. Sanders; Peters D. Weinstein

(57) ABSTRACT

The present invention provides an ammunition disabling system for selectively disabling ammunition that is operatively coupled to a selectively changeable material. In the operative state the material permits transmission of a percussive impact through the material for enabling firing of the ammunition; and in the deactivated state the material inhibits transmission of the percussion wave through the material for preventing firing of the ammunition. The ammunition disabling system includes an energy wave generator with an energy wave source that emits an energy wave at a frequency resonant a natural frequency of the material. When the ammunition with the material are exposed to the energy wave, the energy wave induces a response (physical and/or chemical) in the material that results in a mechanical change in the material from the operative state to the deactivated state by degrading the mechanical structure of the material.

29 Claims, 15 Drawing Sheets

(51) Int. Cl.

| | |
|---|---|
| ***F42C 15/00*** | (2006.01) |
| ***F42C 15/42*** | (2006.01) |
| ***F42C 19/04*** | (2006.01) |
| ***F42C 19/10*** | (2006.01) |
| ***F42C 19/08*** | (2006.01) |
| *F42B 5/26* | (2006.01) |
| *F42C 15/34* | (2006.01) |

(52) U.S. Cl.
CPC ..... *F42C 19/0823* (2013.01); *F42C 19/10* (2013.01); *F42B 5/02* (2013.01); *F42B 5/26* (2013.01); *F42C 15/34* (2013.01)

(58) Field of Classification Search
CPC ..... F42C 13/047; F42C 13/06; F42C 13/08; F42C 15/00; F42C 15/32; F42C 15/36; F42C 15/38; F42C 15/40; F42C 15/42; F42C 19/0823; F42C 19/08; F42C 19/10
See application file for complete search history.

(56) References Cited

U.S. PATENT DOCUMENTS 4,848,233 A 7/1989 Dow
5,272,828 A * 12/1993 Petrick ..... F41A 9/61 42/50
5,301,448 A * 4/1994 Petrick ..... F41A 9/65 102/201
5,373,790 A * 12/1994 Chemiere ..... F42B 12/58 102/226
5,485,786 A * 1/1996 Hesse ..... F41A 19/58 102/202.5
5,937,557 A * 8/1999 Bowker ..... F41A 17/066 102/472
6,283,034 B1 * 9/2001 Miles, Jr. ..... F42B 5/08 102/202.5
6,298,787 B1 * 10/2001 Warnagiris ..... F41H 13/00 102/498
6,760,992 B2 * 7/2004 Brosow ..... F41A 17/063 42/70.04
7,770,316 B2 * 8/2010 Meyerle ..... F41A 17/063 102/202.5
7,958,662 B2 6/2011 Mossberg
8,171,850 B2 5/2012 Hanchett
8,955,421 B1 * 2/2015 Kountotsis ..... F41C 27/00 89/1.11
9,435,597 B2 * 9/2016 Goren ..... F41A 17/063
2002/0092438 A1 * 7/2002 Makowiecki ..... C06B 21/0066 102/205
2006/0117632 A1 6/2006 Meyerle
2006/0279452 A1 * 12/2006 Thomas ..... F42C 13/042 342/68
2009/0038496 A1 * 2/2009 Maegerlein ..... F42C 15/38 102/222
2009/0194744 A1 * 8/2009 Adebimpe ..... A01K 15/02 252/408.1
2011/0212320 A1 * 9/2011 Greenhill ..... A42B 3/12 428/313.3
2012/0199689 A1 * 8/2012 Burkland ..... F42B 15/01 244/3.16
2014/0083318 A1 * 3/2014 Tempi ..... F41A 17/063 102/215
2014/0176330 A1 * 6/2014 Gerfast ..... F42B 12/387 340/572.1
2015/0233660 A1 * 8/2015 Barton ..... F41A 17/08 89/27.12
2015/0330757 A1 * 11/2015 Soohoo ..... F42C 15/34 102/335
2016/0047616 A1 2/2016 Giebel
2016/0161233 A1 * 6/2016 Creedican ..... F41H 13/0081 102/205

OTHER PUBLICATIONS

Lysov, et al., "Preparation of Nickel Oxide Nanostructured Powders under the Action of Ultrasound," Nanotechnologies in Russia, vol. 5, Nos. 7-8, pp. 493-497.

* cited by examiner

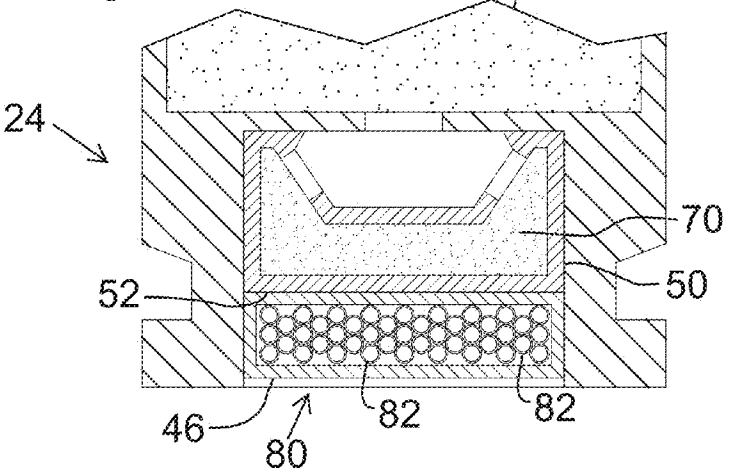
Fig. 14
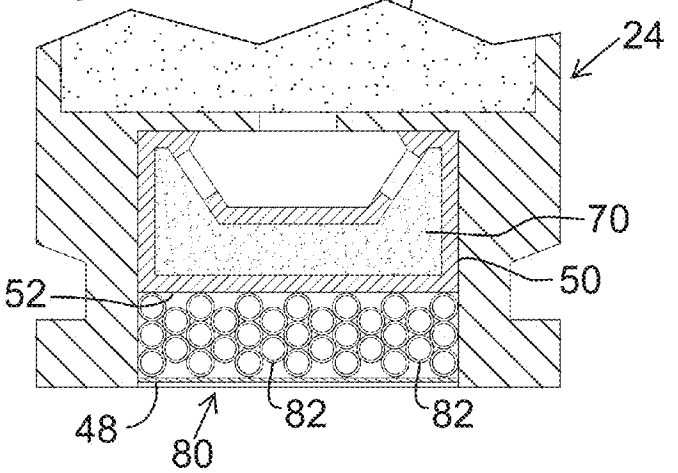
Fig. 13
Fig. 16
Fig. 15

SELECTIVELY DISABLED AMMUNITION AND REMOTE AMMUNITION DISABLING SYSTEM AND METHOD OF USE

This application claims the benefit of priority pursuant to 35 U.S.C. 119(e) to U.S. Provisional Patent Application 62/307,977, filed on Mar. 14, 2016, the contents of each of which are hereby incorporated by reference in its entirety.

BACKGROUND

Applicant hereby incorporates herein by reference any and all patents, published patent applications, and other publications cited or referred to in this specification.

By way of background, gun violence has become all too common in the United States, and really the world over, in recent years, as evidenced by the senseless and tragic shootings at public schools in Columbine, Colo. in 1999 and Newtown, Conn. in 2012, on college campuses from coast to coast, such as Virginia Tech in 2007 and Umpqua Community College in Oregon in 2015, at a Denver, Colo. movie theater in 2012, and at a South Carolina church in 2015. Gun control advocacy group EVERY TOWN FOR GUN SAFETY has identified at least ninety-four (94) school shootings alone in thirty-three (33) states since the Newtown massacre, which left 20 children and 6 teachers dead, according to an article in The Huffington Post on Jan. 18, 2016. Other sources indicate that in just the year 2015 there were at least three hundred fifty-five (355) mass shootings in the U.S. alone.

Though gun laws and gun rights is an ageless debate and legal, regulatory, and technological solutions to the problem of gun violence and gun-related crimes have been sought for decades if not centuries, recent "mass shootings" and other gun violence as highlighted above has sparked even more interest in finding ways to curb gun violence, to this point without much if any success. In general, proposals for gun laws relate to restrictions on and documenting and tracking who can purchase or has purchased firearms, magazines or to limitations or regulations on the types of firearms and ammunition that can be purchased, which actions have virtually no impact on the roughly over three hundred million firearms already in the United States. Some states, such as California, Colorado, Connecticut, Hawaii, Maryland, Massachusetts, New Jersey, and New York, have enacted laws limiting magazine capacity. Ultimately, of course, in the United States any such rules, laws, and regulations and related gun and ammunition technologies are in tension with and are to be consistent with or not run afoul of the fundamental right to lawfully "keep and bear arms" under the Second Amendment of the U.S. Constitution.

In terms of technology, personalized guns or "smart guns" have been developed in recent years that include a safety feature or features that allow them to fire only when activated by an authorized user (i.e., the owner). These safety features are intended to prevent misuse, accidental shootings, gun thefts, use of the weapon against the owner, and self-harm by distinguishing between authorized users and unauthorized users in several different ways, including the use of RFID chips or other proximity tokens, fingerprint recognition, magnetic rings, or mechanical locks, though it will be appreciated that such "smart guns" can do nothing about an authorized user firing them, in any location or direction and at any person or object.

More recently, microstamping has been proposed, which entails laser etching the firing pin and breech face of a semi-automatic firearm, for example, so that when a round is fired a unique identifying mark is left on the primer by the firing pin and another is left on the cartridge case by the breech face etching. This approach to identifying a shooter by the discharged casings is rife with shortcomings. For one, the microstamping technology only links a casing to a gun, not necessarily a shooter. And even the link to a particular gun can be foiled by removing casings from a crime scene or salting the crime scene with casings from other guns or using a revolver or other weapon that does not discharge the casings. Semiautomatic weapons sold with microstamping technology can also be easily retrofitted by replacing the firing pin, slide, barrel or ejector as needed to effectively disable the microstamping feature. Or the etching can be removed using a diamond-coated file or may simply wear away after a number of rounds are fired. And, as noted above, any such technology has no bearing on the over three hundred million guns already in the United States. Fundamentally, microstamping and other such techniques at best can help link a firearm and potentially an owner or user to a crime, but have virtually no impact on actually preventing a gun-related crime in the first place they can serve as a deterrent but can in no way actually stop a gun from being fired.

In attempting to address the ammunition itself rather than the firearms, there has been proposed in U.S. Pat. No. 6,881,284 a "limited-life cartridge primer" that utilizes an explosive that can be designed to become inactive in a predetermined period of time: a limited-life primer. The explosive or combustible material of the primer is an inorganic reactive multilayer (RML). The reaction products of the RML are sub-micron grains of non-corrosive inorganic compounds that would have no harmful effects on firearms or cartridge cases, with the sensitivity of an RML determined by the physical structure and the stored interfacial energy and lowering with time due to a decrease in interfacial energy resulting from interdiffusion of the elemental layers. Time-dependent interdiffusion being predictable, the functional lifetime of an RML primer may be predetermined by the initial thickness and materials selection of the reacting layers. Without regard to the efficacy of this approach or any commercial adoption thereof, it will be appreciated that such RML layer interdiffusion or other such chemical degradation essentially would only render ammunition inactive over time or in a time-dependent manner, not being capable of selectively disabling ammunition at any particular, desired time or doing so in a location-dependent manner.

Thus, there still exists a need for a technology that has heretofore been unavailable that can directly impact and selectively control or disable the use or operation of firearms based on their location, thereby preventing essentially unlawful uses while allowing lawful uses such as self-defense, hunting, and recreation. Such a solution would provide a substantial safety benefit and prevention of certain mass shootings and other gun violence and would preferably achieve this result without any changes to or retrofitting of existing firearms and ammunition configurations, thereby being effective in both new and existing firearms, thus providing a practical solution for the roughly three hundred million guns already in the United States.

Aspects of the present invention fulfill these needs and provide further related advantages as described in the following summary.

SUMMARY

Aspects of the present invention teach certain benefits in construction and use which give rise to the exemplary advantages described below.

The present invention solves the problems described above, and more, by providing an ammunition disabling system for selectively disabling ammunition that is operatively coupled to a material, where the material is selectively changeable from an operative state to a deactivated state. In the operative state the material permits transmission of a percussive impact through the material for enabling firing of the ammunition; and in the deactivated state the material inhibits transmission of the percussion wave through the material for preventing firing of the ammunition. The ammunition disabling system generally comprises an energy wave generator with an energy wave source that emits an energy wave through the air to create a protected space, where the energy wave is emitted at a frequency resonant a natural frequency of the material. When the ammunition is positioned within the protective space the material can be selectively exposed to the energy wave; and, upon exposure to the energy wave, the energy wave induces a response (physical and/or chemical) in the material that results in a mechanical change in the material from the operative state to the deactivated state by degrading the mechanical structure of the material.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings:

FIG. 13 is a partial schematic cross-sectional side view of an alternative exemplary primer and material arrangement of the present invention, in accordance with at least one embodiment;

FIG. 14 is a partial schematic cross-sectional side view of an alternative exemplary primer and material arrangement of the present invention, in accordance with at least one embodiment;

FIG. 15 is a partial schematic cross-sectional side view of an alternative exemplary primer and material arrangement of the present invention, in accordance with at least one embodiment;

FIG. 16 is a partial schematic cross-sectional side view of an alternative exemplary primer and material arrangement of the present invention, in accordance with at least one embodiment;

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

DETAILED DESCRIPTION

Turning first to FIG. 1A, there is shown a schematic cross-sectional side view of an illustrative prior art ammunition A generally comprising a bullet B and a case C having a primer cavity E opposite the bullet B in which a primer P is positioned. As is known in the art, the case C may be filled in whole or in part beneath the bullet B with a propellant R, commonly and generically referred to as "gun powder." Typically, the primer P is formed having a flat bottom configured to be struck by the firing pin I (FIGS. 2A and 2B) of a firearm (not shown) into which the ammunition A is loaded so as to then detonate an explosive mixture or priming compound M housed within the primer P, which in turn detonates the propellant R as by "flashing" through the flash hole F communicating between the primer cavity E and thus the primer P and the interior space of the case C where the propellant R is contained, thereby igniting the propellant R and causing an explosion so as to thus fire the bullet B. As used herein, a firing pin I can be in any known means to strike the ammunition for discharging the firearm, including strikers, hammers, and the like.

Figure 1:
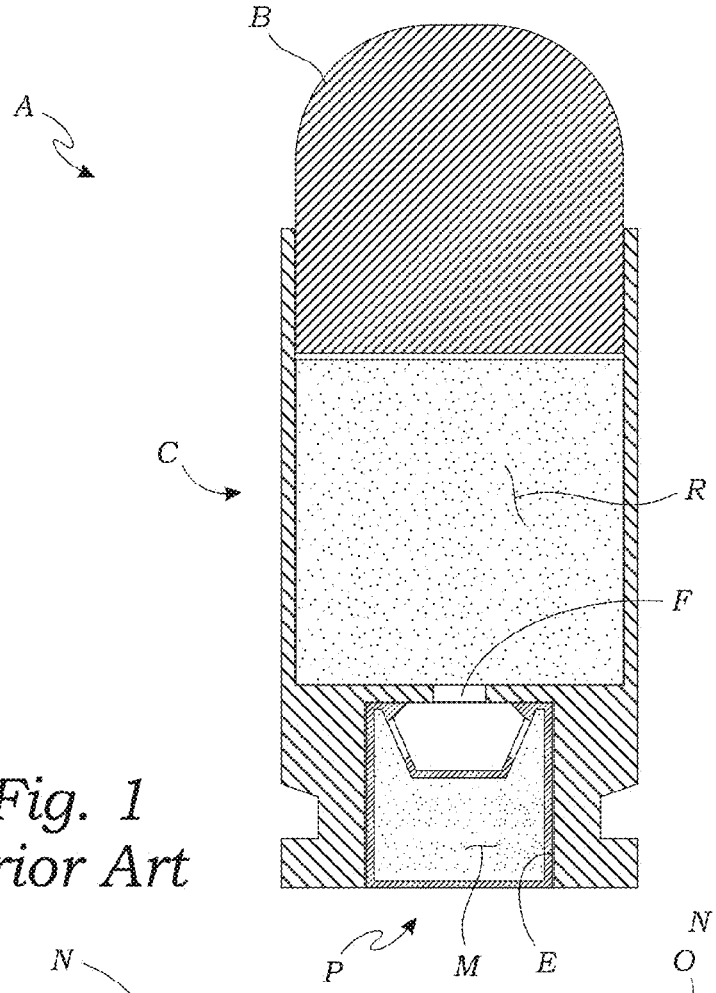
Fig. 1 Prior Art
FIG. 1 (Prior Art) is a schematic cross-sectional side view of a representative prior art ammunition.
Figure 2A:
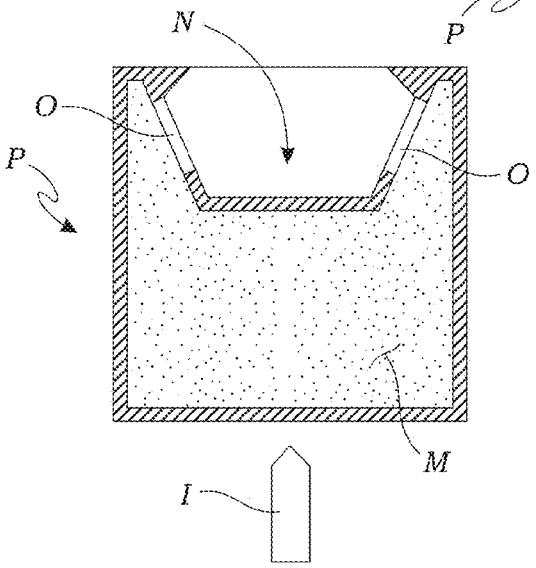
Fig. 2A Prior Art
FIG. 2A (Prior Art) is an enlarged schematic cross-sectional side view illustrating a representative primer thereof, here in a first mode of operation with the primer not detonated.
Figure 2B:
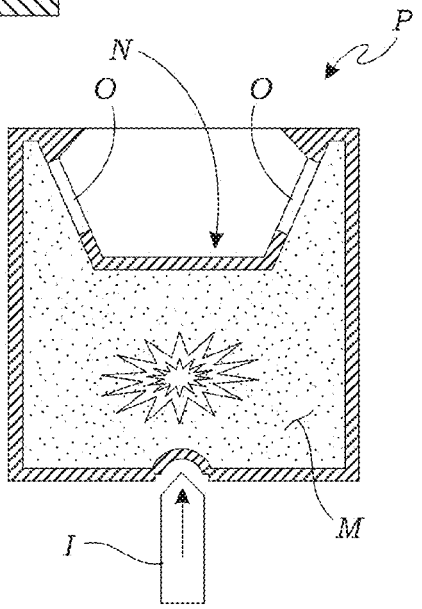
Fig. 2B Prior Art
FIG. 2B (Prior Art) is a schematic cross-sectional side view of the primer of FIG. 2A, here in a second mode of operation with the primer detonated.

By way of illustration and not limitation, the primer mixture (also known as priming compound) M may be a compound including one or more of lead (Pb) azide, lead (Pb) styphnate, lead (Pb) thiocyanate, barium nitrate, antimony trisulfide, powdered aluminum, powdered tetrazene, potassium perchlorate, and diazodinitrophenol (DDNP), fulminated mercury, or other compound. In a bit more detail regarding the primer P, with reference to the enlarged schematic cross-sectional side views of FIGS. 2A and 2B, in its "unfired" configuration or first mode of operation with the primer P not detonated, the strike hammer or firing pin I is simply adjacent the bottom of the primer P and the explosive compound or mixture M is dormant or undetonated. Then, as shown in FIG. 2B, when the gun is fired, the firing pin I is caused to strike the bottom of the primer P, which creates mechanical vibrational waves, shock energy waves, percussion waves that propagate into and through the primer mixture M, increasing the internal kinetic energy, causing the priming compound M to explode as illustrated. It will be appreciated that while a firing pin I is shown and described throughout, any such hardware incorporated within a gun so as to strike and fire a bullet, including but not limited to a hammer or striker, is encompassed, such that the term "firing pin" is to be understood as being all-inclusive and not any specific firearm device. Though not shown, this explosion of the primer mixture M in turn causes a flame or flash of heat or fire to pass out of the primer P through the flash hole F and into the propellant R (FIG. 1), igniting it and causing an explosion and rapid pressure surge of expanding hot gas that shoots or pushes the bullet B out of the case C (FIG. 1) and down the barrel of the gun (not shown) toward a desired target, all in a split second. As shown in FIGS. 1 and 2A and 2B, the primer P is typically further formed with an anvil N at its upper end, opposite the side struck by the firing pin I, which anvil N provides a substantially downwardly-facing surface to reflect the shock waves induced by the firing pin I and to effectively allow the primer mixture M to be crushed and/or percussed, thereby better ensuring detonation of the mixture M, with the anvil N further having one or more lateral or side openings O to allow the induced flash to still leave the primer P and ignite the propellant R as above-described and is generally known in the art. It will be appreciated by those skilled in the art that the illustrated ammunition A includes what is commonly referred to as a "centerfire primer," which generally means that the primer P is configured to be struck by the firing pin centrally.

More particularly, the illustrated primer P is commonly referred to as a "Boxer primer," in which design the anvil N is part of the primer P, configured as a downwardly-facing stirrup piece that sits inverted in the primer cup and, when inserted in the case C, is substantially centered beneath a single centered flash hole F. Another common "centerfire" primer or cartridge arrangement, not illustrated, is known as a "Berdan primer," which is characterized generally by having the anvil effectively built or incorporated into the case so as to project downwardly substantially centrally toward the primer, then having usually two flash holes on opposite sides of the anvil. There are also employed, though in relatively fewer applications, so-called "Rimfire primers" that are fired by striking the bottom of the case anywhere (not necessarily the center and oftentimes, as the name implies, the rim). Those skilled in the art will appreciate that while a particular generic Boxer-style "centerfire primer" ammunition arrangement is shown and described herein both in connection with the typical "prior art" ammunition A and with various exemplary embodiments of the ammunition 20 and primer 40 according to aspects of the present invention as illustrated in FIG. 3 and following, this is merely illustrative and non-limiting. That is, it is to be understood that a variety of ammunition and primer arrangements and sizes, both now known and later developed, may be employed in conjunction with the present invention without departing from its spirit and scope, both in terms of the physical, mechanical design of the primer, as in part dictated by the overall configuration of the ammunition, and in terms of the explosive primer mixture that may be selectively employed therein.

More generally, it is to be expressly understood and appreciated as a threshold matter that all figures are effectively schematics to illustrate the design and function of various ammunition and primers and so are not to be taken literally or to scale. Relatedly, the proportional size or actual dimensions are not shown by or to be taken from the drawings, except as expressly noted, and even then for illustration only, which drawings are simply to illustrate the configurations of the primers and various components thereof and not their exact sizes or dimensions, in any absolute or relative sense. Particularly, once more, as it relates to the overall ammunition configuration and the selection and resulting illustration of a particular primer as being of the "Boxer" variety versus "Berdan" or "Rimfire" or any other such arrangement now known or later developed, it is to be understood that all primers shown and described may have their dimensions and proportional sizes, such as the width or diameter of a primer relative to its height, modified to suit a particular ammunition configuration. By way of further illustration and not limitation, those skilled in the art will appreciate that ammunition is generally sized to different barrel inside diameters or bores, known as "calibers," typically ranging from 0.17 inch (4 mm) to 0.50 inch (12.7 mm), with the most common sizes generally being the 0.22 inch (5.56 mm) caliber, the 0.357 inch (9 mm) caliber, and the 0.45 inch (11.43 mm) caliber. Again, other sizes or calibers of ammunition beyond those described above, whether now known or later developed, may be employed according to aspects of the present invention. For each such caliber gun and ammo category, different primer sizes have been employed accordingly, with some standardization developing so that primers can be universally built and selectively installed in cases or cartridges of known or spec'd ammunition. Ultimately, as set forth in more detail below, it is preferred that primers according to aspects of the present invention be configured to fit within primer cavities of ammunition cartridges or cases now known or later developed so as to not require redesign or customization of either the ammunition itself (case and bullet) or the related firearms, which those skilled in the art will appreciate has tremendous advantage in implementation and use. Accordingly, once more, it will be appreciated that the drawings and related description herein are merely illustrative of ideas, concepts, features and aspects of the present invention and are thus non-limiting; other configurations and sizes of primers and related ammunition now known or later developed may be practiced according to aspects of the present invention without departing from its spirit and scope.

Figure 3A:
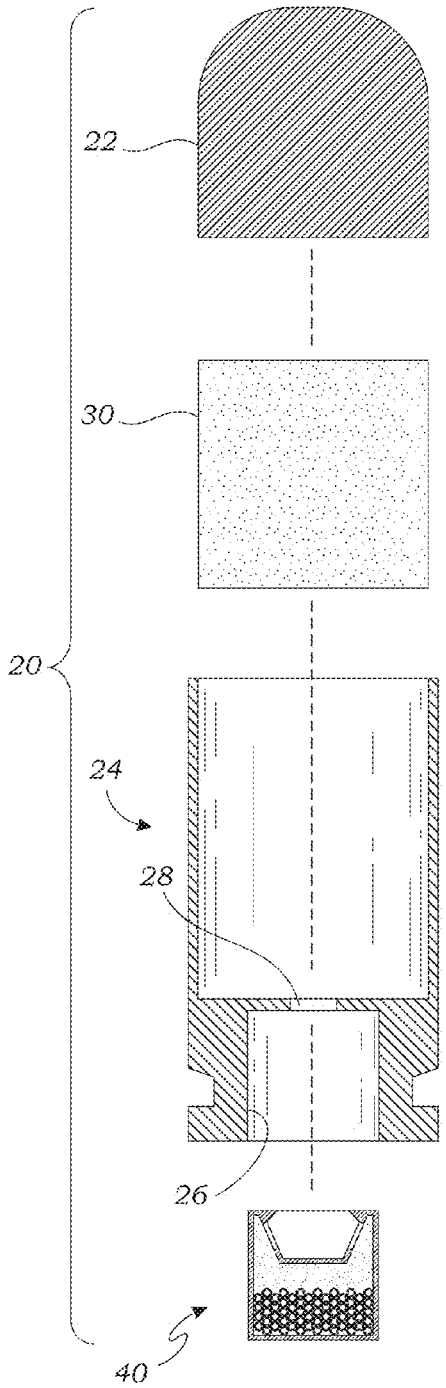
FIG. 3A is an exploded schematic cross-sectional side view of an exemplary ammunition of the present invention, in accordance with at least one embodiment.
Figure 3B:
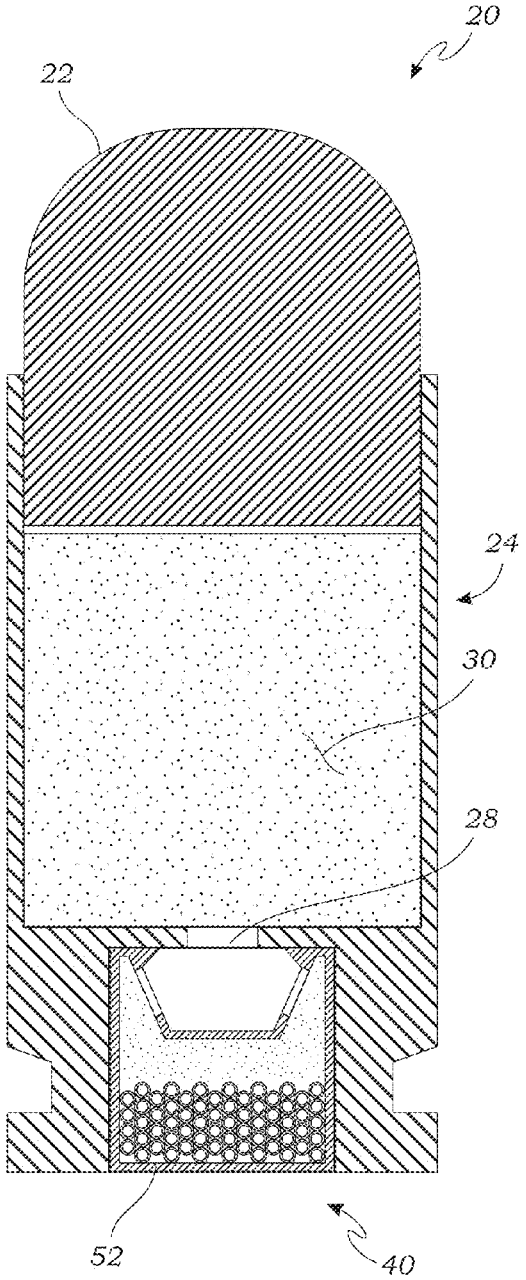
FIG. 3B is an enlarged assembled schematic cross-sectional side view thereof, in accordance with at least one embodiment.

Referring now to FIGS. 3A and 3B, there are shown exploded and assembled schematic cross-sectional side views of a first exemplary ammunition 20 according to aspects of the present invention generally comprising a bullet 22 and a case 24 having a primer cavity 26 opposite the bullet 22 in which a primer 40 is positioned. Once more, the actual and proportional sizes of the components are not to be taken literally or to scale and are non-limiting and illustrative, though for purposes of illustration it is to be understood that the case 24 is generally configured just as the prior art case C of FIG. 1, on which basis the primer cavity E of the prior art case C is substantially equal in size and shape to the primer cavity 26 of the case 24. Accordingly, it will again be appreciated that the new and novel primer 40 may thus be configured for installation in a standard ammunition case 24, again of any configuration now known or later developed, so as to not require redesign or retrofit of the ammunition (case or bullet) or any firearms such ammunition is to be loaded into and fired from. As such, those skilled in the art will appreciate that the primer 40 is configured in the illustrated embodiment to seat within existing ammunition casings or cartridges, though this is not necessarily the case, as primers according to aspects of the present invention may again be employed in any ammunition cases now known or later developed without departing from the spirit and scope of the invention. As will be discussed in reference to FIGS. 13-16, the present invention may material 80 may be positioned external to the primer cup 50.

By way of further illustration, and as will be appreciated from the below dimensional discussion in connection with FIGS. 9A-9C, one relatively easy modification as needed would be to change the geometry of the anvil 60 (FIG. 4A) to reduce its protrusion into the cup 50 to provide more space for the priming compound 70, which could be done without changing the overall size and shape or "envelope" of the primer 40. In any event, the primer 40 is essentially pressed as by an interference fit into the primer cavity 26 so as to be seated within the case 24 in the finished ammunition 20 as shown in FIG. 3B, with the flat bottom wall 52 exposed for being selectively struck by the firing pin I (FIG. 4 et al.). As also shown, the case 24 may be filled in whole or in part beneath the bullet 22 with a propellant 30 such as "gun powder," with a single central flash hole 28 provided in the bottom of the case 24, again here in the exemplary "Boxer" type "centerfire primer," so as to communicate with the primer cavity 26 and allow ignition of the propellant 30 by the fire flash of the primer 40 caused by detonation of the explosive primer material 70 during use, more about which is said below.

Turning to FIGS. 4A-4D, there are shown enlarged schematic cross-sectional side views of a first exemplary primer 40 as would be included in an ammunition 20 as illustrated in FIGS. 3A and 3B. Once more, the primer 40 has an illustrated overall configuration or defines an "envelope" substantially equivalent to prior art primers P configured for the same or similar cartridge or case C (FIGS. 1 and 2) so as to selectively seat within the primer cavity 26 of the ammunition case 24 to form the finished ammunition 20 (FIGS. 3A and 3B). A notable distinction of the inventive primer 40 over the prior art primer P is the inclusion of a material 80 selectively changeable in response to an external energy wave (changeable by collapsing, deteriorating, fracturing, softening, aggregating, bursting, fragmenting, degrading, or other form of mechanical weakening) in the place of or displacing some of the explosive primer material 70 or otherwise taking up some of the volume within the primer 40 cup 50 (or external from the primer cup 50, as described in additional embodiments).

In the illustrated embodiment, the primer 40 comprises a cup 50 having a bottom wall 52 and a side wall 54 configured to contain a quantity of explosive primer material 70 (also known as priming compound), with the changeable material 80 positioned within the cup 50 between the bottom wall 52 and the primer material 70, or basically underneath the primer material 70 opposite the bullet (with the primer material 70 between the changeable material 80 and the propellant 30), though it will be appreciated that the changeable material 80 may also be positioned, in addition or instead, over and/or adjacent to the explosive primer material 70 in some embodiments. Furthermore, though shown as spanning the width of the cup 50, the changeable material 80 may instead only occupy or span a portion thereof, being surrounded by either the primer material 70 or by some other filler, whether explosive or inert. It will be further appreciated that in some embodiments the cup 50 may not be a separate component but may instead be formed or integrated within the ammunition case 24, such that the bottom and/or side walls 52, 54 are effectively defined by or incorporated within the primer cavity 26. In general, during operation the changeable material 80 may be configured such that in a first state (which may also be called the operative state) it is capable forming a mechanical link for sufficiently transmitting the percussive wave, vibrational energy, shock energy, or crushing force of the firing pin I impacting the bottom wall 52 of the primer cup 50 to the explosive primer material 70 so as to cause it to detonate and such that in a second state (which may also be called the deactivated state) it is selectively collapsed so as to effectively create a void, gap, space, or other change which absorbs the percussive wave or otherwise disrupts the mechanical link so as to sufficiently prevent the vibrational or shock energy or crushing force of the firing pin I impacting the bottom wall 52 of the primer cup 50 from reaching and/or causing the detonation of the explosive primer material 70, thereby selectively neutralizing, deactivating, or disabling the primer 40 and thus the ammunition 20 and not allowing it to be fired. It will thus be appreciated by those skilled in the art that "collapsible" or being able to "collapse" is to be understood broadly as that quality or feature of any structure or material that enables it to shift into a state wherein the structure or material occupies a relatively smaller space or volume or such state in which the structure or material is otherwise inhibited from or no longer able to transmit to the primer material a force or energy sufficient to cause detonation (such as being compressible, partitionable, frangible, and the like). In the first state the material 80 may also be sufficiently incompressible so that it can form the required mechanical link; and in the second state, the material 80

Figure 4A:
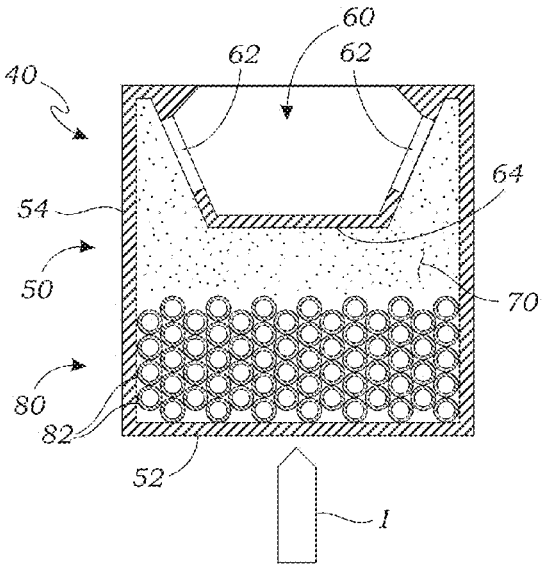
FIG. 4A is an enlarged schematic cross-sectional side view of an exemplary primer of the present invention, in accordance with at least one embodiment, here in a first mode of operation with the primer not struck or detonated or disabled.

In the illustrated embodiment of FIG. 4A, the changeable material 80 (in this embodiment a collapsible material) is configured as a layer of microspheres 82 along the bottom wall 52 of the primer cup 50 so as to effectively fill the bottom portion of the space within the cup 50. Above the microspheres 82 there is filled or layered a select quantity of explosive primer material 70. Also in the illustrated embodiment, the primer 40 includes an anvil 60 at its upper end opposite the bottom wall 52, the anvil 60 here again being configured as the prior art anvil N illustrative of a conventional "Boxer" style "centerfire primer," though once more such configuration of the overall primer 40 and any related anvil 60 being merely exemplary and non-limiting. More will be said about the microspheres 82 below, particularly in connection with FIGS. 10A-10D, but here it is noted that the microspheres 82 or any other such changeable material 80 are configured of a size and shape and material so as to provide in its normal or first or operable configuration sufficient rigidity or to be sufficiently strong and thereby convey or transmit percussive, vibratory, or shock waves or impact forces, whether individually or as a layer, from the firing pin I through the bottom wall 52 below the microspheres 82 to the primer material 70 above the microspheres 82 so as to still enable detonation and thus firing of the ammunition 20 (FIGS. 3A and 3B), while the microspheres 82 are further able under certain selective conditions to be capable of collapse and thus be rendered inactive or unable to sufficiently transmit vibratory or shock waves or impact forces to the primer material 70, thereby effectively disabling the primer 40 and the host ammunition 20. It will be appreciated, including with reference to the further embodiments shown and described herein, that a variety of other forms of the selectively changeable material 80 beyond the layer of microspheres 82 shown in FIGS. 4A-4D is possible according to aspects of the present invention without departing from its spirit and scope (as described in reference to FIGS. 15 and 16 below). By way of illustration and not limitation, rather than a layer of multiple microspheres, there could instead be a single disc or pancake-shaped hollow member (i.e., a single "microsphere") capable of transmitting energy or force when not disabled and creating a void when it is disabled or collapsed. Conversely, the plurality of microspheres 82 may not in fact be spherical, but could instead be oblong, amorphous, or some other shape while still functioning according to aspects of the present invention. Again, by way of illustration and not limitation, rather than a layer of multiple microspheres, there could instead be material that is solid, hollow, gas-filled, or other structure, such as a plate, a disk, a slug, a column, a coating, a plurality of microspheres, a plurality of particles, a lattice, a compacted material, a solid material, or a loosely packed material.

Continuing with the exemplary embodiment of FIG. 4A, the primer 40 is shown in a first mode of operation with the primer 40 not struck or detonated or disabled, the firing pin I simply being adjacent to the primer 40 in the "ready to fire" position. Again, no distances, such as the spacing from the firing pin I to the bottom wall 52, are to be understood from the schematic representations of the figures. As a further threshold matter, it is noted that the orientations of the primer 40 and firing pin I are essentially vertical in the figures, while it will be appreciated that in use such components would rather typically be oriented substantially horizontally. It is expected that the present invention would operate in substantially the same manner in any orientation and that gravity or gravitational effects are expected to be substantially negligible in use. By way of illustration and not limitation, the selectively changeable material 80, such as microspheres 82 in the exemplary embodiment, may be closely packed or even somewhat unitary in construction, as through slight fusing or adhesion between the surfaces of adjacent microspheres 82. Instead or in addition, the layer or filler of primer material 70 may be substantially solid or semi-solid or otherwise not readily flowable such that it also serves to maintain substantially a consistent shape and/or to exert a substantially constant force or retention on the selectively collapsible material 80 layer to further assist in maintaining the relative positions of the components within the primer 40, again regardless of its physical orientation. In fact, in the exemplary embodiment wherein the explosive primer material 70 is a lead (Pb) azide- or lead (Pb) styphnate-based compound, for example, it will be appreciated that such compounds are characterized as being somewhat clay-like in consistency; however, it will be appreciated that other materials and phases or consistencies are possible according to aspects of the present invention. Thus, for ease of viewing and explanation, the primer 40 and firing pin I are shown oriented vertically in the figures, though again this will be appreciated as simply illustrative and non-limiting.

Figure 4B:
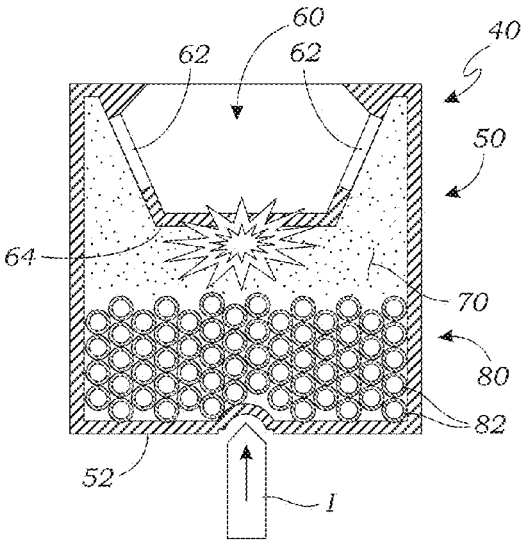
FIG. 4B is a schematic cross-sectional side view of the primer of FIG. 4A, in accordance with at least one embodiment, here in a second mode of operation with the primer struck and detonated.

Turning to FIG. 4B, in a second mode of operation, the primer 40 is now struck and detonated, as by rapidly shifting the firing pin I into the bottom wall 52 of the primer cup 50 (i.e., "firing" or discharging the firearm). Such action effectively causes a percussive, vibrational, or shock wave to pass through the primer 40 and/or a crushing force to be applied to the primer 40. In the illustrated embodiment, such force is first transmitted through the microspheres 82 defining the layer of selectively collapsible material 80, which at this point are not collapsed or deactivated. The "force" can again be a percussive, vibrational, shock, or other such energy wave induced by the firing pin l's strike against the primer bottom wall 52 and/or a mechanical force as by even physically lifting the microspheres 82 located above the area where the firing pin I struck and mechanically deformed or indented the primer bottom wall 52, in either case such energy or force being transmitted from the firing pin I through the microspheres 82 to the primer material 70, thereby percussing, crushing, or otherwise detonating the primer material 70 and causing an explosive flash that then passes through the one or more openings 62 in the anvil 60 and further through the flash hole 28 into the case 24 so as to ignite the propellant 30 (i.e., gun powder or other such material) and "fire" the bullet 22 (FIGS. 3A and 3B). In the illustrated "Boxer" primer arrangement, it will be appreciated that, specifically, the explosive primer material 70 may be crushed or pinched between the lifted microspheres 82 and the bottom wall 64 of the anvil 60, thereby causing the illustrated detonation. Along with the microspheres 82, small solid particles (not shown) may be added to the layer of selectively collapsible material 80 to further facilitate the energy transfer from the firing pin I to the explosive primer material 70 and thereby help ensure detonation when the ammunition 20 is in its active (non-disabled) state as shown in FIG. 4B.

Figure 4C:
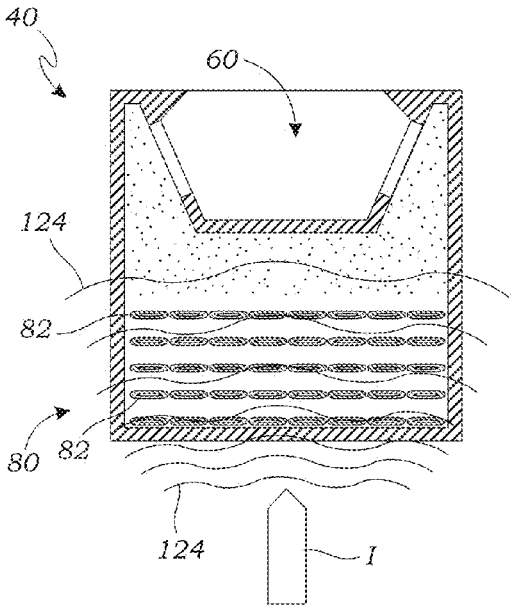
FIG. 4C is a schematic cross-sectional side view of the primer of FIG. 4A, in accordance with at least one embodiment, here in a third mode of operation with the primer not struck or detonated and now disabled.
Figure 4D:
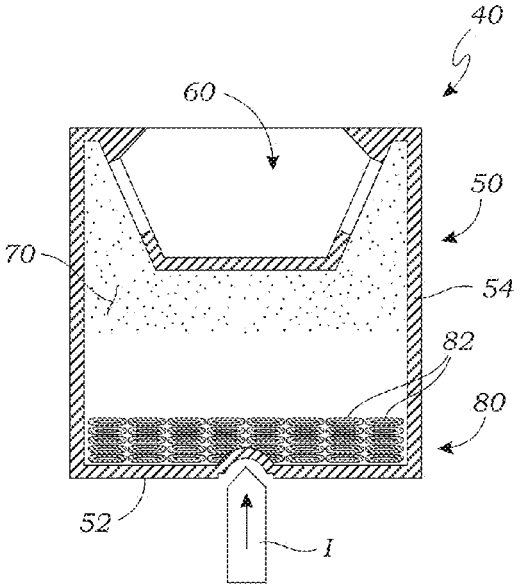
FIG. 4D is a schematic cross-sectional side view of the primer of FIG. 4C, in accordance with at least one embodiment, here in a fourth mode of operation with the primer disabled and then struck and so not detonated.

Alternatively, in a third mode of operation of the primer 40 of FIG. 4A, prior to the primer 40 being struck or detonated, it can instead be disabled as shown in FIG. 4C by, for example, passing one or more particular energy waves 124 through the primer 40 that serve to, one or more of, break apart, shrink, aggregate, sinter, burst, deflate, collapse, and/or undergo a morphologic change in the at least some of microspheres 82 or other component(s) comprising the selectively changeable material 80 that is layered within the primer 40, more about which energy waves is said below particularly in connection with FIGS. 10A-10D and the "science" of the selectively changeable material 80. As illustrated in FIG. 4C, the energy waves 124 serve to physically collapse the selectively collapsible material 80, here layers of discrete microspheres 82, so that they are effectively flattened or even break apart altogether, in a deactivated state. The result is gaps or voids throughout what was once a fairly cohesive layer of the selectively collapsible material 80. As best seen in FIG. 4D, in a fourth mode when the microspheres 82 or selectively collapsible material 80 is fully collapsed and settles to the bottom of the primer cup 50, there is a fairly substantial void or gap between what remains of the microspheres 82 and the explosive primer material 70. Based on the foregoing discussion and as will generally be appreciated by those skilled in the art, the primer material 70 being in most cases clay-like, solid, or not a flowable material such as liquid or powder, remains substantially adhered in position where it was at the upper end of the primer cup 50, or closer to and substantially about the anvil 60, regardless of the orientation of the primer 40. As shown particularly in FIG. 4D, with the primer 40 oriented vertically upward, as when the gun (not shown) is raised or pointed upward, the collapsed or disrupted microspheres 82 or other such material may thus have a tendency to sink to or collect on the bottom wall 52 of the primer cup 50; however, where the weapon (not shown) in which the ammunition 20 (FIGS. 3A and 3B) is loaded is holstered or otherwise pointed downwardly, the collapsed microspheres 82 may instead collect against the primer material 70 at the top or nose-end of the primer 40, in which case there would still remain a mechanical gap between the bottom wall 52 struck by the firing pin I and the primer material 70. Or, where the weapon is held somewhat horizontally as in the typical firing position and thus the ammunition 20 and primer 40 is also generally horizontal, the collapsed microspheres 82 may instead settle to one side within the primer cup 50, essentially pooling against one side wall 54. In any event, it will be appreciated that in all such instances, or any orientation of the gun and loaded ammo 20 and hence primer 40, the selectively collapsible material 80 such as microspheres 82 being collapsed renders there no longer a direct mechanical link or connection between the primer bottom wall 52 and the primer material 70, thereby disabling the primer 40 and hence the ammunition 20 irrespective of any gravitational effects. In fact, in one exemplary embodiment, the microspheres 82 or other selectively changeable material 80 are configured such that the total volume of material in the collapsed state is one-half or less of the total volume within the primer cup 50 bounded by the cup bottom and side walls 52, 54 and the primer material 70 so as to insure that, for example, when the gun (not shown) and hence ammunition 20 and primer 40 are oriented horizontally and the collapsed microspheres 82 settle to one side there is still insufficient material to bridge between the primer bottom wall 52 and the primer material 70, thereby ensuring that the primer 40 is disabled (i.e., that the primer material 70 cannot be detonated) and the ammunition 20 cannot be fired. Alternatively, the deactivated microspheres 82 or other selectively changeable material 80 may simply burst (or otherwise be mechanically disrupted or compromised) and stay in place without creating an actual gap between the priming material 70 and the selectively changeable material 80; instead, in the deactivated state, the selectively changeable material 80 absorbs or otherwise disperses a sufficient portion of the percussive impact so that the primer material 70 cannot be detonated.

It will again be appreciated that such may be accomplished in a virtually infinite variety of primer arrangements and employing a wide range of selectively collapsible materials (types and arrangements of materials) without departing from the spirit and scope of the invention, such that the exemplary embodiment of FIGS. 4A-4D is to be understood as illustrative and non-limiting. Regarding the purpose and context for selectively disabling the primer 40 through any such means, more is said below in connection with FIGS. 12A-12D, though it will be appreciated that generally the idea is that when a gun (not shown) loaded with ammunition 20 according to aspects of the present invention is carried into certain public places equipped with at least one energy wave generator 122, such ammunition 20, and particularly the primer 40 thereof, is thus disabled as described herein, thereby preventing the gun from being fired and potentially saving lives.

Figure 5A:
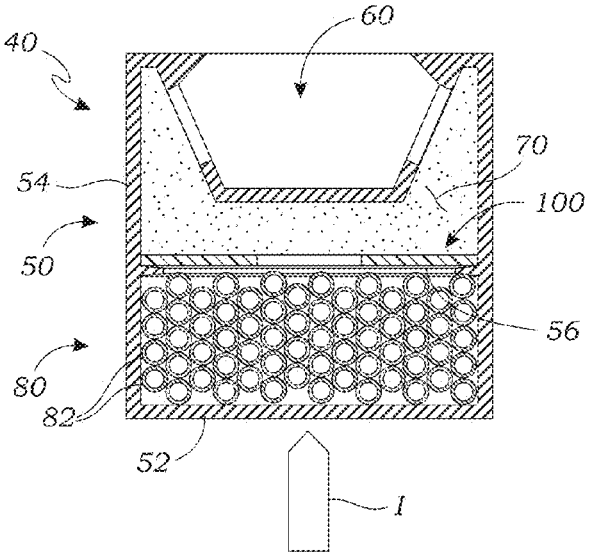
FIG. 5A is a schematic cross-sectional side view of an alternative exemplary primer of the present invention, in accordance with at least one embodiment, here in a first mode of operation with the primer not struck or detonated or disabled.
Figure 5B:
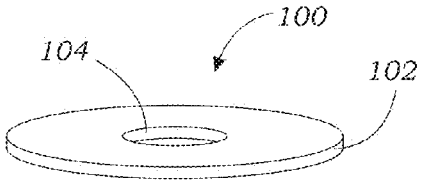
FIG. 5B is a schematic perspective view of an exemplary component of the primer of FIG. 5A, in accordance with at least one embodiment.

Turning to FIG. 5A, there is shown a further alternative arrangement of a primer 40 according to aspects of the present invention similar to that of FIG. 4A, except now there is added a support washer 100 as a barrier layer between the primer material 70 and the selectively collapsible material 80. Such support washer 100 may be free-floating within the primer cup 50, essentially resting on top of the layer of microspheres 82, or may instead be supported on an inwardly-projecting support lip 56 formed on the primer side wall 54, which lip 56 may be continuous or intermittent. In either case (support lip 56 or no support lip 56), the support washer 100 may distribute the load across the microspheres 82 and/or facilitate loading or packing the primer material 70 from above without adversely affecting the microspheres 82 or the primer material 70 and rendering further predictability in manufacturing or loading of ammunition 20 (FIGS. 3A and 3B). As best shown in the perspective view of FIG. 5B, in the exemplary context of substantially annular ballistics, such that the primer cup 50 itself is substantially annular, the support washer 100 is also formed so as to be annular, having a circular outer perimeter edge 102 substantially corresponding to the inside diameter of the primer cup 50, or the inner surface of the cup side wall 54. The support washer 100 is further formed with a substantially centered through-hole 104, which it will be appreciated allows for mechanical, vibrational, or shock-wave energy to pass therethrough to the explosive primer material 70 that lies just beyond the washer 100. Relatedly, the support washer 100 would serve to block, disperse, or dampen any energy that may be off-center or not directly along the line of the firing pin I in the common "centerfire" primer arrangement, as might be the case as noted above when the firearm (not shown) is in the substantially horizontal position and the collapsed microspheres 82 or other material may pool between the primer cup bottom wall 52 and the primer material 70 basically off-center or to one side. It will be further appreciated that such arrangement of the support washer 100 would be equally beneficial whether a Boxer- or Berdan-style centerline primer cartridge is to be employed, whereas for a Rimfire primer cartridge, the washer 100 may not be employed or may be configured differently, such as with openings around its perimeter edge 102 rather than one central opening 104.

Figure 6A:
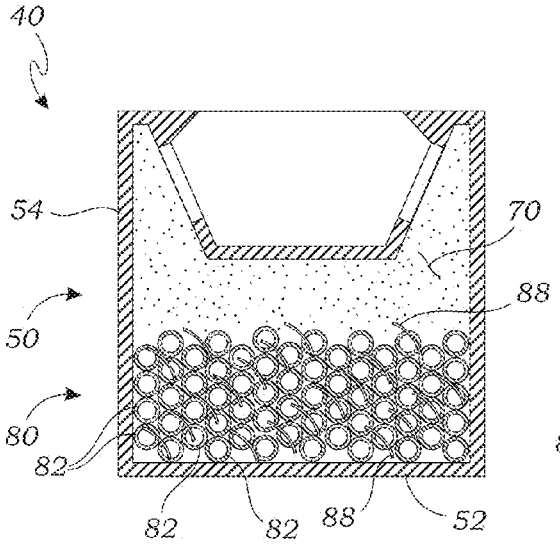
FIG. 6A is a schematic cross-sectional side view of a further alternative exemplary primer of the present invention, in accordance with at least one embodiment, here in a first mode of operation with the primer not struck or detonated or disabled.
Figure 6B:
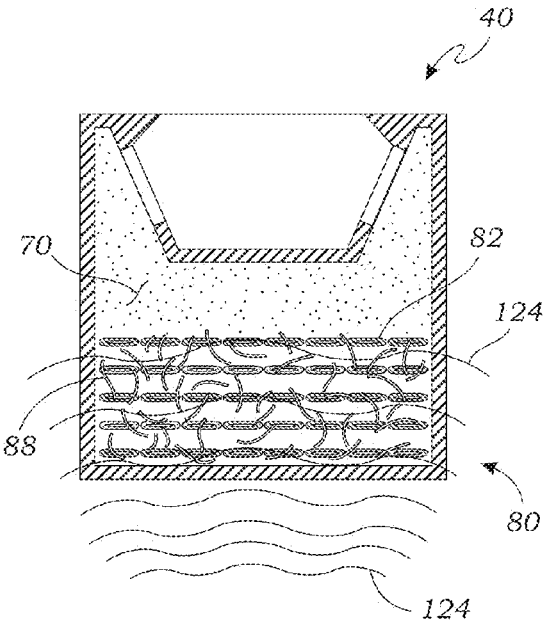
FIG. 6B is a schematic cross-sectional side view of the primer of FIG. 6A, in accordance with at least one embodiment, here in a third mode of operation with the primer not struck or detonated and now disabled.

Referring next briefly to FIGS. 6A and 6B, there are shown schematic cross-sectional side views of a further alternative embodiment primer 40 according to aspects of the present invention, here configured much like that of FIG. 4A with a layer of microspheres 82 as the selectively changeable material 80 beneath the primer material 70, or positioned between the bottom wall 52 of the primer cup 50 and the primer material 70, only now having added amongst the microspheres 82 metal fibers 88 or other fibers or a second material or materials of varying geometry that facilitates the selective collapsing, shredding, or bursting of the microspheres 82, and/or that provide additional structural support to the microspheres (or material 80 in general) to further facilitate transmission of the percussive wave to the primer material 70. For example, with the fibers 88 being adjacent and in contact with various ones of the microspheres 82, when the primer 40 is exposed to energy waves 124 the vibration induced in the fibers 88 may assist in or contribute to the rupturing or collapsing of at least some of the microspheres 82, as shown in FIG. 6B, which again results in essentially deactivating or disabling the primer 40 and hence the ammunition 20 the primer 40 is inserted in (FIGS. 3A and 3B). Those skilled in the art will appreciate that the number, size, placement and type of material of the fibers 88 may vary depending on a number of factors, particularly the configuration of the microspheres 82 and thus what kind of added functionality may assist in their selective collapse. Indeed, while the fibers 88 may be formed of metal such as aluminum or copper, it will be appreciated that other non-metal materials and composites may also be employed as being responsive to the selected energy wavelengths employed.

Figure 7A:
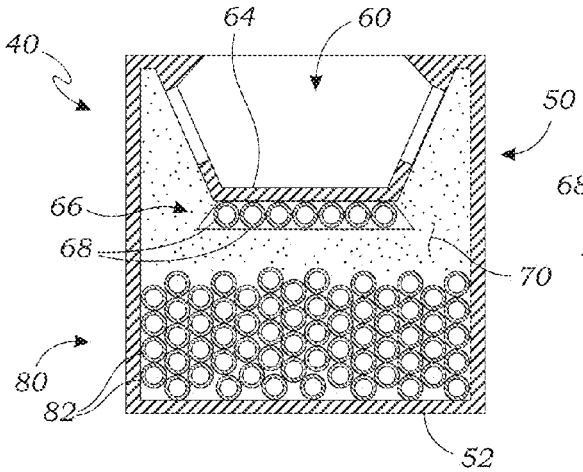
FIG. 7A is a schematic cross-sectional side view of a further alternative exemplary primer of the present invention, in accordance with at least one embodiment, here in a first mode of operation with the primer not struck or detonated or disabled.
Figure 7B:
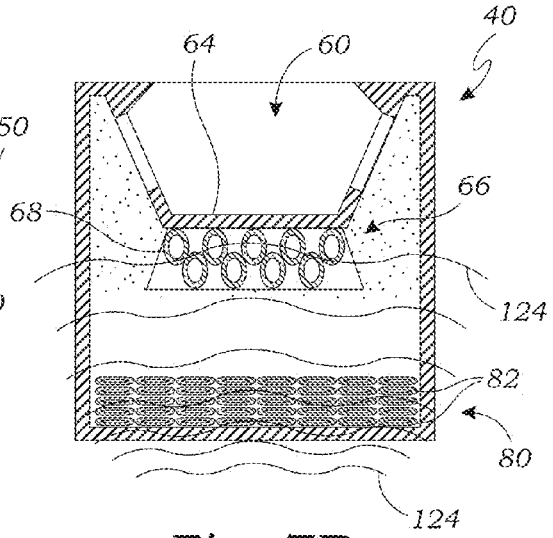
FIG. 7B is a schematic cross-sectional side view of the primer of FIG. 7A, in accordance with at least one embodiment, here in a third mode of operation with the primer not struck or detonated and now disabled.
Figure 7C:
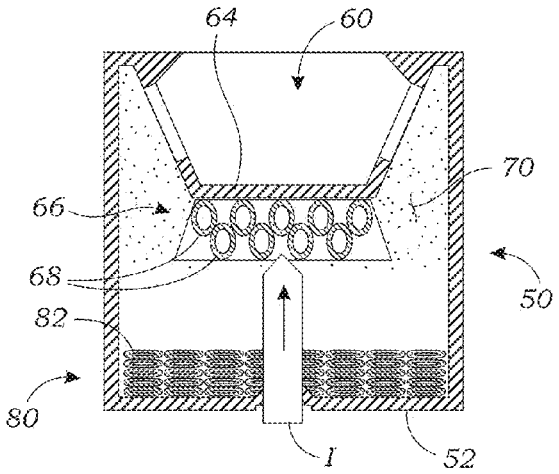
FIG. 7C is a schematic cross-sectional side view of the primer of FIG. 7B, in accordance with at least one embodiment, here in a fourth mode of operation with the primer disabled and then struck and so not detonated.

Turning now to FIGS. 7A-7C, a still further alternative exemplary embodiment primer 40 according to aspects of the present invention is shown in multiple modes of operation. Once more, the alternative primer 40 is quite similar to that of FIG. 4A, again having a layer of microspheres 82 beneath the primer material 70, closest to the bottom wall 52 of the primer cup 50. Only here, there is a second layer of microspheres 68 beneath the bottom wall 64 of the anvil 60 so as to form a shock-absorbing layer 66 that may further selectively assist in disabling the primer 40. While the layer 66 is shown as being relatively thin or as having microspheres 68 of such a size as to essentially comprise a single row of microspheres 68 as illustrated, those skilled in the art will appreciate that such shock-absorbing layer 66 may configured in a variety of other ways without departing from the spirit and scope of the invention, including the layer 66 not even having microspheres 68 but instead being comprised of some other material or structure or the layer not necessarily covering or extending along the full anvil bottom wall 64. Regardless, the idea or purpose behind the shock-absorbing layer 66 is to further prevent unwanted detonation of the primer material 70 within the primer 40, as by blunting, absorbing, or diffusing any mechanical or shock or vibrational energy directed toward the anvil 60. In one embodiment such may be accomplished based on the presence of the shock-absorbing layer 66 unaltered; that is, the presence of the shock-absorbing layer 66 and it being composed of a material that is not disabled upon exposure to one or more particular energy waves 124 may alone provide the desired energy dampening effect when the firing pin I (FIG. 7C) strikes the primer bottom wall 52.

Figure 8A:
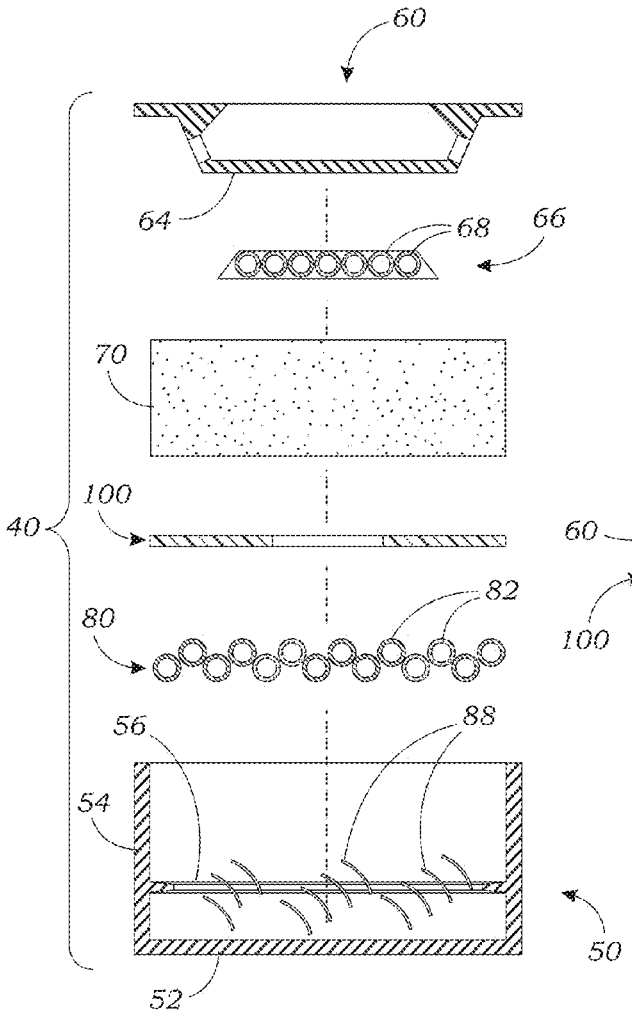
FIG. 8A is an exploded schematic cross-sectional side view of a further alternative exemplary primer of the present invention, in accordance with at least one embodiment.
Figure 8B:
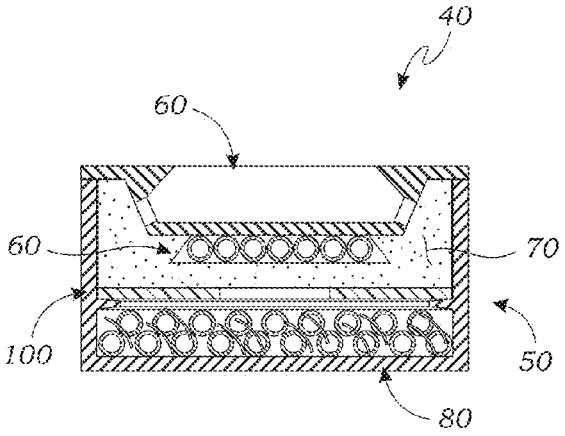
FIG. 8B is an assembled schematic cross-sectional side view of the primer of FIG. 8A, in accordance with at least one embodiment.

In other embodiments, the shock-absorbing layer 66 may be composed of microspheres 68 that actually harden and/or expand when exposed to such energy waves 124 as illustrated in FIG. 7B so as to further blunt or absorb any energy resulting from firing pin I impact. As also shown in FIG. 7B, if the microspheres 68 of the shock-absorbing layer 66 expand, in one exemplary embodiment, the layer 66 thus serves to displace some of the primer material 70 from beneath it, thereby further reducing the likelihood of detonation, which is again desired in the context of exposure of the primer 40 to select energy wave(s) so as to ultimately prevent unwanted or unsafe firing of a weapon (not shown). Turning briefly to FIG. 7C, there is shown a firing pin I that has not just struck the primer bottom wall 52 but has passed therethrough and come closer to the anvil bottom wall 64. Those skilled in the art will appreciate that on occasion a firing pin I may strike the cup bottom wall 52 with such force and/or the bottom wall 52 be relatively weakened so that the pin I can actually break through the bottom wall 52 of the primer 40 and traverse some distance therein toward the anvil 60, thereby potentially detonating the primer material 70 as by striking the primer material 70 directly or the anvil bottom wall 64 directly so as to cause a crushing or such a mechanical or vibrational shock that the primer material 70 explodes even when the primer 40 has supposed to have been disabled as by being exposed to certain energy waves 124. Such action of the firing pin I is not typical and generally not desired, though it will be appreciated that such can happen, particularly when the overall primer 40 configuration is relatively flatter or shallower, such as illustrated in FIGS. 8A and 8B discussed below, it being further appreciated that the relatively tall primers 40 illustrated are a bit exaggerated from what is typical. Accordingly, once again, by placing a shock-absorbing layer 66, here of selectively expanding microspheres 68, immediately beneath the anvil bottom wall 64, in the event of primer 40 disablement as by exposing the primer 40 to select energy wave(s) as herein described wherein it is desired that the primer 40 not be detonated and the related ammunition 20 (FIGS. 3A and 3B) not be fired, it follows that even were the firing pin I to penetrate the primer 40, the presence and selective expansion of the shock-absorbing layer 66 thus prevents unwanted detonation of the primer material 70. Again, those skilled in the art will appreciate that the actual and proportional size of the primer 40, including the pre- and post-expansion shock-absorbing layer 66, and the related travel of the firing pin I are exaggerated in FIGS. 7A-7C to illustrate features and aspects of the present invention, such that these figures, once more, as all the others, are not to be taken literally or to scale but are merely illustrative and non-limiting.

It will be appreciated by those skilled in the art that while the exemplary alternative embodiments of the primer 40 according to aspects of the present invention are shown in FIGS. 4-7 as essentially adding or varying one feature each, any such features may be combined in virtually any manner to yield still further exemplary embodiments. That is, for example, two or more of the illustrated features or any other such features may be combined to produce further alternative primer 40 arrangements beyond those expressly shown and described. By way of further illustration and not limitation, then, reference is now made to the exploded and assembled cross-sectional side views of still another exemplary primer 40 shown in FIGS. 8A and 8B. Here, effectively all separately disclosed optional features are brought together as a further alternative primer 40 assembly, including the shock-absorbing layer 66 beneath the anvil 60, the support washer 100 between the primer material 70 and the selectively changeable material 80, and the fibers 88 within the primer cup 50 interspersed among the microspheres 82 of the selectively changeable material 80 layer. Again, those skilled in the art will appreciate that any and all such features and/or other related features may be combined in a variety of ways beyond those shown and described without departing from the spirit and scope of the present invention, such that all illustrated primers 40 are to be understood as exemplary and non-limiting. Relatedly, once more, while the drawings are not to be taken literally or to scale, it will be appreciated that a general comparison of FIG. 8 to FIGS. 4-7 reveals that the primer cup 50 is shown as being proportionally shorter or shallower, with the anvil 60 being a separate component installed over the top or opening of the cup 50. Those skilled in the art will again appreciate that none of the drawings are to be taken as true scale or even as being proportionally scaled, each instead being shown to simply convey the exemplary inventive concepts. Moreover, any materials and methods of construction and related means of assembly, now known or later developed, are contemplated according to aspects of the present invention, such that, for example, whether or how the anvil 60 is formed and integrated with the cup 50 may vary without departing from the spirit and scope of the invention. Again, the inclusion of one or more optional features such as the support washer 100 and the method of doing so in the fabrication or assembly of the finished primer 40 may again vary according to aspects of the invention, such that any particular illustrated embodiment is to be understood as exemplary and non-limiting.

Figure 9A:
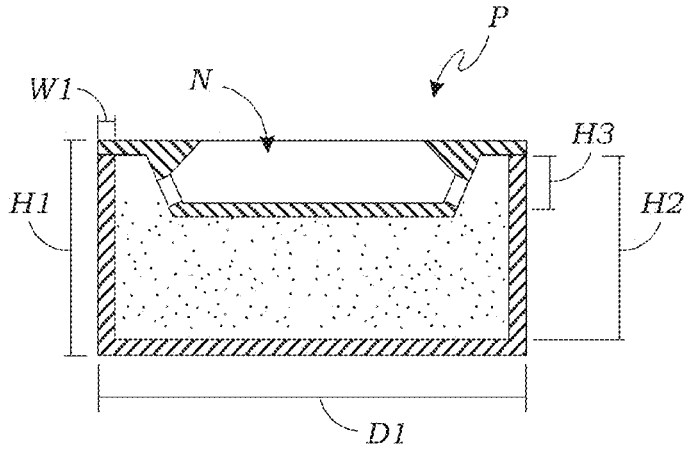
Fig. 9A Prior Art
FIG. 9A (Prior Art) is a schematic cross-sectional side view of a further representative primer.
Figure 9B:
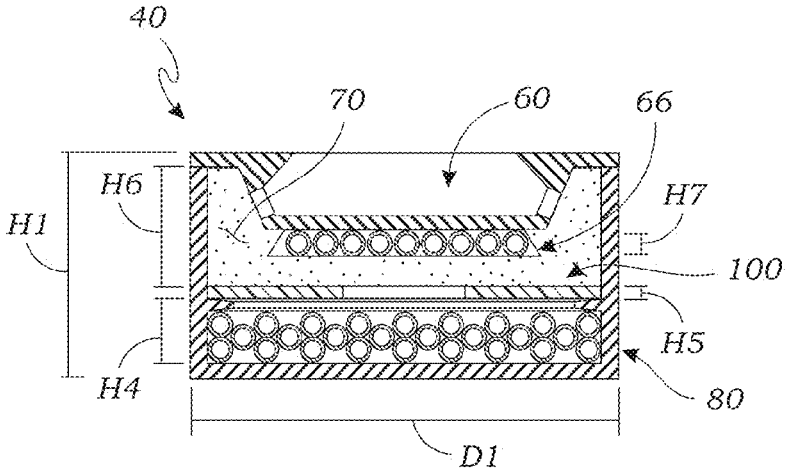
FIG. 9B is a schematic cross-sectional side view of a further alternative exemplary primer of the present invention, in accordance with at least one embodiment, here in a first mode of operation with the primer not struck or detonated or disabled.
Figure 9C:
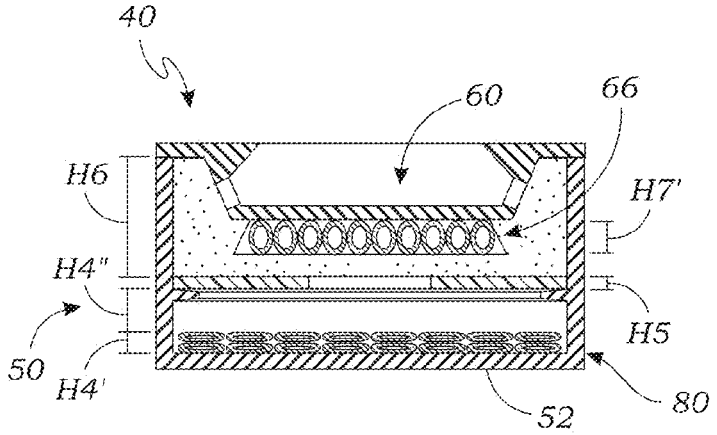
FIG. 9C is a schematic cross-sectional side view of the primer of FIG. 9B, in accordance with at least one embodiment, here in a third mode of operation with the primer not struck or detonated and now disabled.

Referring next to FIGS. 9A-9C, there are shown an illustrative prior art primer P with representative dimensional call-outs (FIG. 9A) and then an exemplary primer 40 according to aspects of the present invention in a first mode of operation with the primer 40 not struck or detonated or disabled (FIG. 9B) and then in a third mode of operation with the primer 40 not struck or detonated and now disabled (FIG. 9C), with representative dimensional call-outs for such new and novel primer 40 for comparison with the prior art primer P and between the "before and after" disablement configurations (the second and fourth modes of the primer 40 wherein it is detonated, whether not disabled or disabled, respectively, are not shown here as not adding anything to the discussion of the exemplary dimensions). As a threshold matter, it will again be appreciated and is to be expressly understood that all actual or proportional dimensional call-outs are illustrative and non-limiting, as such can vary widely depending on the caliber of the ammunition 20 (FIGS. 3A and 3B) and other design considerations and resulting product configurations, it again being noted that any materials and methods of construction now known or later developed may be employed in the present invention without departing from its spirit and scope. In present ammunition, again being generally sized to different barrel inside diameters or bores, known as "calibers," the typical size range is from 0.17 inch (4 mm) to 0.50 inch (12.7 mm), with the most common sizes generally being the 0.22 inch (5.56 mm) caliber, the 0.357 inch (9 mm) caliber, and the 0.45 inch (11.43 mm) caliber. Though there is still in the industry a wide variety of related primer sizes from manufacturer to manufacturer, some standardization has been implemented. As such, for typical Boxer primers, which again is the primer type illustrated in the exemplary embodiments of the present invention, there are generally four primer diameters that are most often employed: (1) 0.175 inch (4.45 mm) diameter "small pistol primers" used with calibers such as the "0.357"; (2) 0.209 inch (5.31 mm) diameter primers for shotgun shells and inline muzzleloaders; (3) 0.210 inch (5.33 mm) diameter "large rifle primers" and "large pistol primers" each having a slightly different cartridge configuration relating to the type of weapon and firing pin operation and impact force; and (4) 0.315 inch (8.00 mm) diameter "0.50 BMG primers" for the 0.50 Browning Machine Gun cartridge and derivatives. The height or thickness of most primers P and 40 is in the range of 0.100 to 0.125 inch (approximately 2.50 to 3.25 mm). For purposes of illustration relative to FIGS. 9A-9C, there are shown primers P and 40 nominally configured for small or large pistols, the primers P and 40 having a nominal outside diameter of 5.0 mm and a nominal height of 3.0 mm, such again being illustrative and it being fundamentally appreciated that both primers P and 40 are substantially the same in overall dimension to allow for the new and novel primers 40 according to aspects of the present invention to be installed in conventional ammunition A, and particularly the primer cavity E formed in the cartridge or case C (FIG. 1), so as to enable the improvement of ammunition 20 that may be selectively disabled yet without having to redesign the ammunition or the weapon (not shown) it is loaded in and fired from. Referring first to FIG. 9A, then, the illustrated conventional or "prior art" primer P with anvil N again has an overall width or diameter D1 of 5.00 mm and an overall height H1 of 3.00 mm. With nominal wall thicknesses W1 of 0.25 mm, it follows that the interior cup height H2 is then 2.50 mm (with an outer cup height of nominally 2.75 mm in this configuration with the anvil N installed on top of the primer cup). The nominal or maximum height or more accurately protrusion depth H3 of the anvil N is 0.75 mm in this exemplary typical primer P arrangement. By comparison, with reference now to FIG. 9B showing a primer 40 according to aspects of the present invention, while the overall width or diameter D1 is again nominally 5.00 mm and the overall height H1 is again nominally 3.00 mm, due to the changes within the primer 40 the interior dimensions may vary or be represented differently, though again, for example, with the overall size or "envelope" of the primer 40 being substantially equivalent to the conventional primer P, the interior cup height H2 would again be nominally 2.50 mm in this example and the protrusion length H3 of the anvil 60 would again be nominally 0.75 mm. As will be appreciated, the overall interior cup height H2 is in this example composed of the thickness H4 of the selectively collapsible material 80 layer, the thickness H5 of the support washer 100, and the distance H6 from the top of the support washer 100 to the top of the cup 50; that is, H2=H4+H5+H6. In the exemplary embodiment shown in FIGS. 9B and 9C, H4 is nominally 1.00 mm, H5 is nominally 0.25 mm, and H6 is nominally 1.25 mm, adding to the nominal interior cup height H2 of 2.50 mm. With continued reference to FIG. 9B illustrating the exemplary primer 40 according to aspects of the present invention in its first mode as being neither struck nor detonated or disabled (i.e., capable of being fired as having not been exposed to the requisite energy waves but not yet fired), it can be seen that the selectively collapsible material 80 (e.g., microspheres 82 (FIG. 8A)) is not collapsed and so substantially fills the space between the bottom wall 52 of the cup 50 and the support washer 100; particularly, though not shown as having the microspheres 82 extending to the very bottom of the support washer 100 as between the radial support lip 56 (FIG. 5A), it will be appreciated that such space may also be filled in whole or in part by the selectively collapsible material 80. Above the support washer 100 it will be appreciated that the volume within the primer 40 is a bit irregular, though still substantially symmetrical in the exemplary "centerfire" primer context, with the otherwise disc or cylindrical shaped space being partially displaced by the downwardly-protruding anvil 60, which again in the exemplary embodiment has a nominal height H3 of 0.75 mm. Accordingly, it will be appreciated that while about the perimeter of the anvil 60 the primer material 70 is at a full nominal depth of 1.25 mm, in the center, or beneath the anvil 60 or between the anvil 60 and the support washer 100, the nominal depth of the primer material 70 is 0.50 mm. Furthermore, in the exemplary embodiment wherein a shock-absorbing layer 66 is positioned directly beneath the anvil 60, the center depth of the primer material 70 is further reduced as it is displaced all the more by the anvil 60 in combination with the shock-absorbing layer 66. By way of illustration, the nominal "at rest" or un-activated thickness H7 of the shock-absorbing layer is 0.25 mm, resulting in a center thickness of the primer material 70, or thickness directly beneath the anvil 60 and shock-absorbing layer 66 of about 0.25 mm as well. As such, in the non-disabled configuration of the primer 40 as shown in FIG. 9B, it will be appreciated that mechanical or vibrational or shock energy transmitted from impact of the firing pin I (FIGS. 2A and 4A) against the bottom wall 52 of the primer cup 50 and through the selectively collapsible material 80 layer need only agitate or crush that 0.25 mm thick disc or layer of primer material 70 so as to cause a detonation within the primer 40 and fire the ammunition 20. Whereas, with reference now to FIG. 9C, the primer 40 is now shown as disabled, as when it has been exposed to particular energy waves to, as shown and further described throughout, cause the microspheres 82 of the selectively collapsible material 80 layer to collapse. The result is that the thickness or depth H4 of such layer, which is nominally 1.00 mm as shown and described above in connection with FIG. 9B, is effectively divided into two distinct layers for purposes of illustration (assuming here horizontal orientation of the primer 40 and resulting gravitational effects): a layer of collapsed material 80 settled along the bottom wall 52 represented by thickness H4'; and a void or gap above the collapsed material 80 layer, between the collapsed material 80 and the support washer 100 represented by thickness H4", where H4=H4'+H4". In the illustrated embodiment, H4' is nominally 0.40 mm and H4" is nominally 0.60 mm. As also shown in FIG. 9C, upon exposure to select energy waves, while the microspheres 82 of the selectively collapsible material 80 layer may collapse or break apart, in one exemplary embodiment the microspheres 68 (FIGS. 7A-7C) of the shock-absorbing layer 66 may harden and/or expand so as to prevent unwanted detonation as by energy or the firing pin I itself striking the anvil 60. In the exemplary embodiment, the shock-absorbing layer may expand in thickness by about fifty percent (50%), such that the nominal thickness H7 of the layer 66 of 0.25 mm may increase to approximately 0.35 to 0.40 mm, then leaving nominally 0.10 to 0.15 mm for the primer material 70 between the expanded shock-absorbing layer 66 and the support washer 100. As shown, expansion of the shock-absorbing microspheres 68 and related layer 66 further displaces primer material 70 or reduces the amount or thickness of primer material 70 beneath the anvil 60. That effect coupled with the collapse of the selectively collapsible material 80 results in disablement of the primer 40, with there again being a void layer H4" effectively between the bottom wall 52 of the primer cup 50 and the primer material 70 and further energy dissipation at the anvil 60. Those skilled in the art will appreciate that all such dimensions are again illustrative and non-limiting and that a variety of other such dimensional characteristics is possible depending on the overall size and configuration of the primer 40 and the included features, as in part dictated by the ammunition 20 that the primer 40 is to be placed in. If, for example, additional space for the layers within the primer 40 or to better accommodate particularly the selectively collapsible material 80 and the formation of a sufficient gap resulting from disabling such layer 80 and thus the primer 40 was desired, such could relatively easily be accomplished by modifying the geometry of the anvil 60, which could be done without changing the overall size and shape or "envelope" of the primer 40. It will be further appreciated that for purposes of illustration "round numbers" have been used but that even the overall dimensions of the primer 40 may not and likely would not be precisely 5.00 mm in diameter and 3.00 mm in height, such that these overall dimensions and the resulting inner dimensions of the components and layers is again merely exemplary. It will also be appreciated that the thicknesses of the various layers can differ from those described even staying within the nominal 5.00 mm×3.00 mm "envelope" for the representative Boxer centerfire primer 40. For example, while the support washer 100 is described as having a nominal thickness of 0.25 mm, it may be thinner, such as on the order of 0.10 mm, or in other embodiments even thicker. Regardless, and whether or not a support washer 100 is even employed, it will be appreciated that there may be some interspersing of the primer material 70 and the selectively collapsible material 80 along their interface, such that the clean, defined, substantially planar interface may in reality not be the case, with again in the support washer 100 context one or both of the primer material 70 and the selectively collapsible material 80 potentially even squeezing into the through-hole 104 (FIG. 5B) of the support washer 100 or particularly the selectively collapsible material 80 filling in behind the support washer 100 including the space bounded by any support lip 56 formed in the cup side wall 54. Fundamentally, those skilled in the art will appreciate once more that the schematic drawings representing features and aspects of the present invention are not to be taken literally but instead as illustrative of such aspects of the invention and non-limiting. Accordingly, again, as one feature is added or removed or dimensional change made other changes are in turn made within the primer 40 construction to accomplish one or more of the design objectives while preferably staying within an overall primer size to suit or fit within existing ammunition configurations, thought that is again not necessarily the case, as particular primers 40 and resulting purpose-built, primer-specific ammunition 20 may also be configured according to aspects of the present invention without departing from its spirit and scope. By way of further illustration and not limitation, at least one or more of the following variables can be modified in particular primer 40 configurations to suit certain objectives, ammunition caliber size constraints, etc.: inner cup height; cup thickness; anvil depth; primer material or mixture; collapsible material size and composition (e.g., microsphere configuration); shock-absorbing material size and composition; support washer size and shape; and size or thickness of void space.

Turning now to FIGS. 10A-10D, there are shown enlarged schematic cross-sectional side views of a single representative microsphere 82 a quantity of which comprises the exemplary selectively changeable or collapsible material 80 employed in any of the exemplary primers 40 of FIGS. 3-9. Once more, none of the drawings are to be taken to scale, in the absolute or proportional sense, as the size and configuration of such microspheres 82 can vary widely in keeping with the aspects of the present invention, and particularly for the purpose of the present focus on the microspheres 82 themselves, none of the drawings are to be taken as a representation or quantification of the number of microspheres 82 that may be employed, which again may vary widely based on the size of the individual microspheres 82 and of the resulting selectively collapsible material 80 layer and the space provided therefor within the primer 40 (FIGS. 3-9). Moreover, while such beads are generically described as or named "microspheres," it is to be understood that "micro" in this context simply means "small" and is not indicative of actual size in any unit of measurement; accordingly, microspheres 82, for example, may include "nanospheres" and other such beads, particles, grains, and the like, whether now known or later developed. Generally, depending on such factors, there may be anywhere from even one or on the order of only a few dozen microspheres 82 to hundreds or even thousands of microspheres 82 in a single primer 40.

Figure 10A:
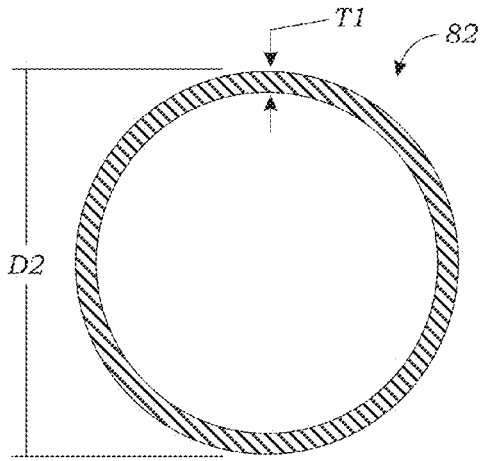
FIG. 10A is an enlarged schematic cross-sectional side view of a representative selectively collapsible material of an exemplary primer of the present invention, in accordance with at least one embodiment, here in a first configuration.

Referring first to FIG. 10A, by way of illustration and not limitation, there is shown a single hollow microsphere 82 having a nominal outside diameter D2 in the range of one micron to one thousand microns (1-1,000 μm or 0.001-1.0 mm) and a nominal wall thickness T1 in the range of a quarter micron to twenty microns or greater (0.25-20 μm). Again, while such may be the typical size range for a "microsphere" when understood as a sphere in the micron size range, again, herein, "microsphere" is to be understood more broadly simply as a "small sphere," such that each microsphere can be smaller or larger than the above noted size range without departing from the spirit and scope of the invention. In the exemplary embodiment of FIGS. 9B and 9C described above wherein the microspheres 82 in their normal state occupy a layer having a nominal thickness of 1.0 mm and then collapse down to a layer having a nominal thickness of on the order of 0.3-0.5 mm, the microspheres 82 may more preferably have a diameter of on the order of ten microns to five hundred microns (10-500 μm or 0.01-0.50 mm), though it will again be appreciated that even a microsphere up to on the order of 1,000 microns or 1.0 mm in diameter could be positioned within such primer 40 and have the desired effect. Each such microsphere 82 can be formed from a variety of natural and synthetic materials, including but not limited to glass, polymer and ceramic, with such polymer materials including but not limited to polyethylene and polystyrene. While a single layer or monolithic wall is shown, it will be appreciated that the microspheres may also be formed having multiple layers of material defining the spherical wall, such as having a thermoplastic shell that encapsulates a low boiling point hydrocarbon. Though shown hollow, such microspheres may also be solid, and where hollow may essentially be evacuated (contain a vacuum and be truly hollow) or may be filled with air or an inert gas such as carbon dioxide ($CO_2$), nitrogen ($N_2$), hydrogen ($H_2$), helium (He), neon (Ne), argon (Ar), krypton (Kr), xenon (Xe), bromine (Br), and dilithium (Dt), or any combination thereof, though any other generally non-reactive gas(es) or gaseous compound(s) may be employed within the microspheres 82 placed in the primer 40 according to aspects of the present invention without departing from its spirit and scope, more about which is said below in connection with FIG. 10D. Exemplary microspheres 82 include the Expancel® line of microspheres by Boud Minerals in the United Kingdom and the Micropearl® line of microspheres by Lehmann & Voss in Germany.

By way of summary, at least six factors may contribute to the selection and performance of a microsphere 82 according to aspects of the present invention, again depending on the application: (1) material of sphere wall; (2) tensile strength of sphere material; (3) resonance frequency (f) of sphere material; (4) gas or air fill of sphere and at what pressure; (5) diameter or cross-sectional size of sphere; and (6) thickness of sphere wall. It will again be appreciated that a variety of microsphere configurations are possible depending on a number of such factors, with any such microsphere 82 as employed herein fundamentally being sufficiently strong in compression to withstand and transmit mechanical forces and/or vibrational or shock waves induced by the impact of the firing pin I on the primer 40 so as to cause the desired detonation of the primer material 70 under normal operation and firing of the ammunition 20 (FIGS. 3A and 3B) while also being susceptible to selective collapse so as to disable or neutralize the primer 40 and thereby not allow the ammunition 20 to operate normally or be fired. Again, a wide variety of microspheres 82 meet this criteria, including those shown and described herein, each of which is to be understood as illustrative and non-limiting.

Figure 10B:
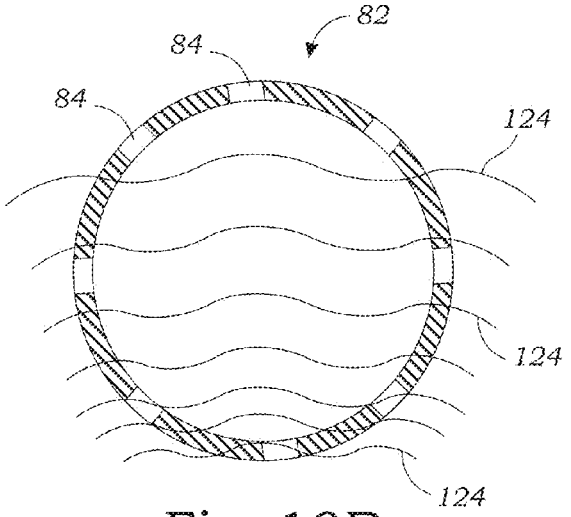
FIG. 10B is a schematic cross-sectional side view of the selectively collapsible material of FIG. 10A, in accordance with at least one embodiment, here as exposed to energy waves and in a second configuration.
Figure 10C:
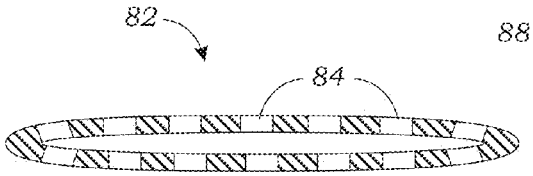
FIG. 10C is a schematic cross-sectional side view of the selectively collapsible material of FIG. 10B, in accordance with at least one embodiment, here in a third configuration.

Shown schematically in FIG. 10B, the illustrated hollow microsphere 82 is exposed to one or more energy waves 124, causing failure points 84 within the sphere wall. And then in FIG. 100, as a result, the microsphere 82 is shown schematically as having collapsed or essentially flattened due to the failure of its spherical wall or surface. Though shown as flattening but otherwise remaining somewhat intact, those skilled in the art will appreciate that the spherical wall may instead break into smaller pieces, in whole or in part, or may not have any failures or breaks but may still weaken to the point of collapse or flattening, either way resulting in the selectively collapsible or changeable material 80 collapsing or compressing down, with the spheres 82 no longer maintaining their shape or having the related mechanical integrity to hold their form and occupy a relatively larger volume within the primer 40 and thereby transmit forces or energy waves to the primer material 70 or otherwise.

Figure 10D:
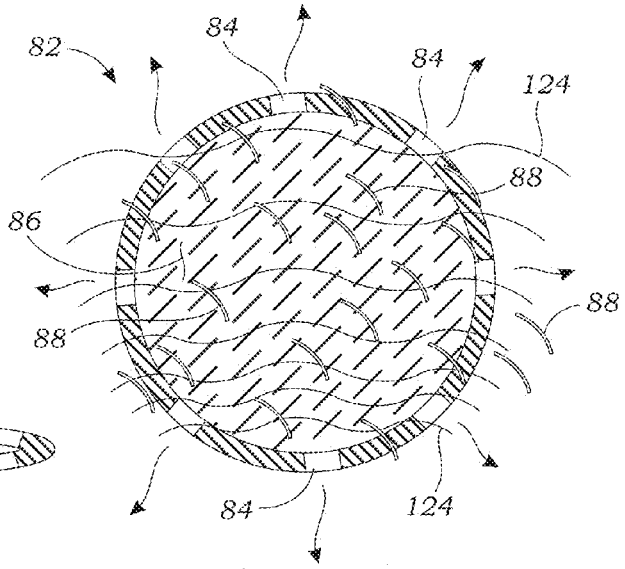
FIG. 10D is a schematic cross-sectional side view of an alternative representative selectively collapsible material, in accordance with at least one embodiment, here as exposed to energy waves and in a second configuration.

It will again be appreciated that the at least one mechanism, if not the primary mechanism, for causing such failure or collapse of the microspheres 82 is energy waves 124 acting on the material of the microspheres 82, more particularly effectively inducing resonance frequency and causing vibration and expansion and/or collapse of the microsphere 82, resonance frequency or mechanical resonance being that tendency of a mechanical system to respond at relatively greater amplitude when the frequency of its oscillations matches the system's natural frequency of vibration (i.e., its resonance frequency). As such, when a particular microsphere 82 is exposed to an energy wave 124 having a frequency that approximates its own resonance frequency (where the frequency, pulse time, and/or power output of the energy wave generator is paired or tuned to the natural frequency of the material), the resulting increased vibrational frequency of the sphere 82 can cause it to break apart and fail and collapse. In one further exemplary embodiment, multiple wave generators 122 (FIG. 12) operating at multiple respective wavelengths may be employed simultaneously as may be multiple different sizes and/or materials of the microspheres 82 within a single primer 40 so as to further render the reaction unique and resistant to ambient sound and to better ensure that at least a sufficient number or portion of the spheres 82 collapse so that the primer 40 and related ammunition 20 is disabled. By way of illustration and not limitation, two to three different energy waves 124 and related generators 122 may be employed, in one embodiment each such generator 122 and wave 124 paired with respective two or three microspheres 82 of particular size and construction. In a bit more detail, any such energy waves 124 may categorically fall within "sound waves" or "light waves" (also known as "radiation" or "electromagnetic radiation," whether the light is visible or invisible), either of which being characterized by frequency, more about which is said below, such that in some systems 120 multiple energy wave generators 122 may be employed, each generating a different kind of wave 124—i.e., one or more generating a sound wave and one or more an electromagnetic wave. With reference to FIG. 10D, there is shown a further schematic cross-sectional side view of a microsphere 82 here with additional collapse-inducing mechanisms employed. First, there is shown metal or other such fibers 88 interspersed or laying or scattered about the microspheres 82. Those skilled in the art will appreciate that such fibers 88 would also have a resonance frequency, and in the exemplary embodiment the material and size of such fibers 88 is selected so as to have a resonance frequency that approximates that of the microsphere 82 so as to also vibrate when exposed to the energy wave 124 and thereby assist in breaking or bursting or otherwise collapsing the microsphere 82. Alternatively, the fibers 88 may be selected having a resonance frequency that by design is different from that of the microsphere 82, with a variety of energy waves 124 then being transmitted, as by one or more wave generators 122 (FIG. 12), so as to separately or individually agitate or induce a resonance frequency response in each of the microspheres 82 and fibers 88, together cooperating to selectively cause the microspheres 82 to collapse. Furthermore, as also shown in FIG. 10D, the microsphere 82 may be filled with a gas 86, again such as carbon dioxide ($CO_2$), nitrogen ($N_2$), or other inert or generally non-reactive gas, which it will be appreciated may expand when exposed to the energy waves 124 and thereby further contribute to rupturing and collapsing the microsphere 82, whether the gas 86 is nominally contained at substantially ambient pressure within the sphere 82 or is already under pressure even before agitation or any exposure to particular energy waves 124. Once more, such agitation or expansion of any such gas 86 may be induced by substantially the same waves 124 or frequencies as affecting the microsphere 82 itself and/or the fibers 88 or may respond to a different energy frequency. In one exemplary embodiment, specifically, three wave generators 122 may be employed emitting three respective energy waves 124, each paired or associated with one of the microsphere 82, the gas within the microsphere 86, and the fibers 88 around or interspersed among the microspheres 88, or as noted above with different microspheres 82 employed within the same primer 40, again by way of illustration and not limitation, with again any such energy waves 124 potentially being of different frequencies and/or types to suit a particular context. Where the microsphere 82 is filled with an inert or substantially non-reactive gas 86, and whether or not such gas 86 in and of itself expands or otherwise contributes to the rupture or collapse of the sphere 82, those skilled in the art will appreciate that such gas would then escape the ruptured or failed sphere 82 and generally fill the space within the primer 40 beneath the explosive primer material 70, thereby helping deny or displace oxygen ($O_2$) or otherwise inhibiting ignition of the primer material 70 and thus further contributing to disabling the primer 40 and preventing the ammunition 20 from being fired. It will be appreciated by those skilled in the art that a variety of combinations of collapse-inducing mechanisms are possible without departing from the spirit and scope of the invention, such that each such mechanism may be employed alone or in combination with any other mechanism now known or later developed according to aspects of the present invention. By way of further example and with specific reference to the one or more energy waves 124 or frequencies that may be employed according to aspects of the present invention, in the exemplary embodiment, ultrasound waves are generated and transmitted so as to induce a response within the primer 40 as above described, which waves are typically in the range of 20,000 Hz or 20 kHz ($10^4$ Hz), or above the range of audible sound, up to 10 MHz ($10^7$ Hz) or greater. It may also be possible to employ so-called infrasound waves that are below the audible range or in the sub 20 Hz range. Where the energy waves 124 are instead light waves or electromagnetic radiation, such are also typically in the range of 1 kHz ($10^3$ Hz) up to 10 MHz ($10^7$ Hz) or greater, though usually no higher than approximately one hundred Terahertz ($10^{14}$ Hz) waves, where the infrared and then the visible light spectrums begin, such range of electromagnetic energy waves of roughly $10^3$ Hz to $10^{14}$ Hz generally comprising long, medium and short wave radio waves and microwaves along with the "terahertz" gap waves between radio waves and infrared light, all generally comprising "non-ionising" radiation. Non-thermal microwaves and conventional radio waves may also be employed, though there is the possibility of metallic shielding that could prevent such waves from reaching and disabling the primer 40. As such, ultrasound waves of varying frequencies again typically in the range of ten Kilohertz ($10^4$ Hz) to Megahertz ($10^6$ Hz) or higher may preferably be employed, as again may be Terahertz electromagnetic waves on the order of one to one hundred Terahertz ($10^{12}$-$10^{14}$ Hz) or long or medium radio waves in the kilohertz to gigahertz range ($10^3$-$10^9$ Hz), for example. Once again, a variety of such energy waves 124 of various kinds and frequencies may be employed according to aspects of the present invention without departing from its spirit and scope. In other microsphere applications, for example, acoustic scattering and transmission are measured in the frequency range from 700 kHz to 12.5 MHz, further demonstrating a workable ultrasonic wave energy range in the context of agitating or inducing a response from a range of microspheres 82, which relatively low power sound waves are in relatively widespread use in medical diagnostics and other applications with no known adverse effects, with further research being done on the less common but quite promising Terahertz waves that may also safely induce a mechanical response in the microspheres 82. Relatedly, while no chemical reaction is induced, per se, the vibrational response or acoustic cavitation, piezoelectric effect and heat generation that is or may be induced through exposure to such energy waves, also known as sonochemistry, particularly where, as here, one frequency range of the energy waves 124 may fall within the ultrasonic spectrum is a related potential contributor to the selective collapse of the microsphere 82 (an example of a possible chemical reaction is described further below in reference to the description of the experimental data). That is, whether filled with gas or perhaps more preferably in this application water, acoustic cavitation induced by ultrasonic energy waves may result in mechanical activation destroying the attractive forces of the molecules in liquid phase such that, with the continued application of or exposure to ultrasound compressing the liquid followed by rarefaction or expansion, in which a sudden pressure drop forms small, oscillating bubbles of gaseous substances which then expand with each cycle or wave of applied ultrasonic energy until they reach an unstable size and collide and/or violently collapse. This potential "bubble within a bubble" phenomenon may also be employed alone or in conjunction with a water releasing compound independent of or part of the microspheres as yet another exemplary contributor to the activation of the selectively collapsible material 80 layer within the primer 40 so as to deactivate or disable it. In this context, it may be possible to employ hydrogel microspheres or other such materials now known or later developed. Once more, those skilled in the art will appreciate that a variety of such materials and wave technologies may be employed, whether now known or later developed, in a primer 40 according to aspects of the present invention without departing from its spirit and scope.

Figure 11A:
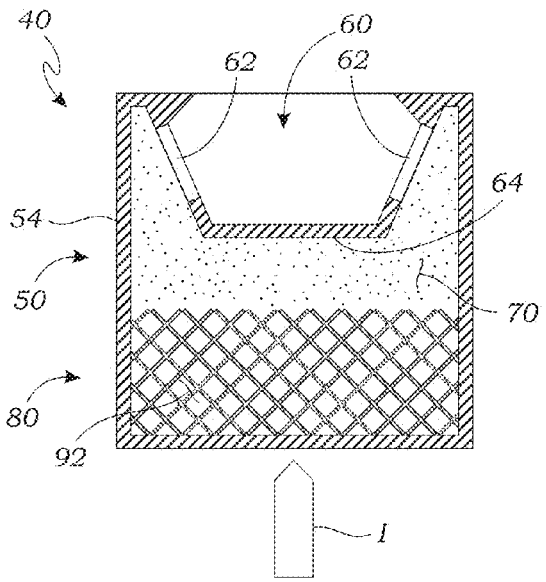
FIG. 11A is a schematic cross-sectional side view of a further alternative exemplary primer of the present invention, in accordance with at least one embodiment, here in a first mode of operation with the primer not struck or detonated or disabled.
Figure 11B:
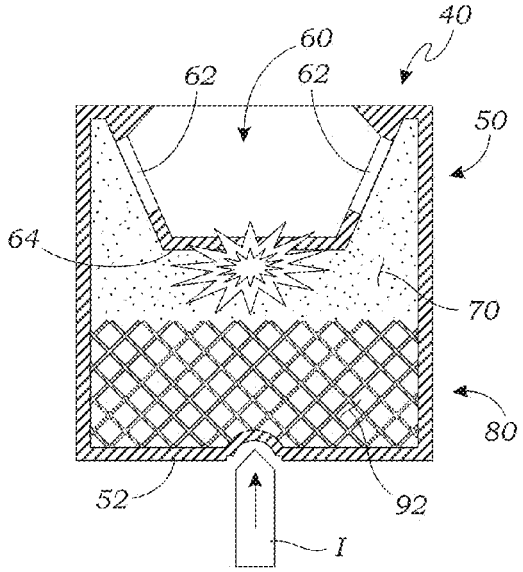
FIG. 11B is a schematic cross-sectional side view of the primer of FIG. 11A, in accordance with at least one embodiment, here in a second mode of operation with the primer struck and detonated.
Figure 11C:
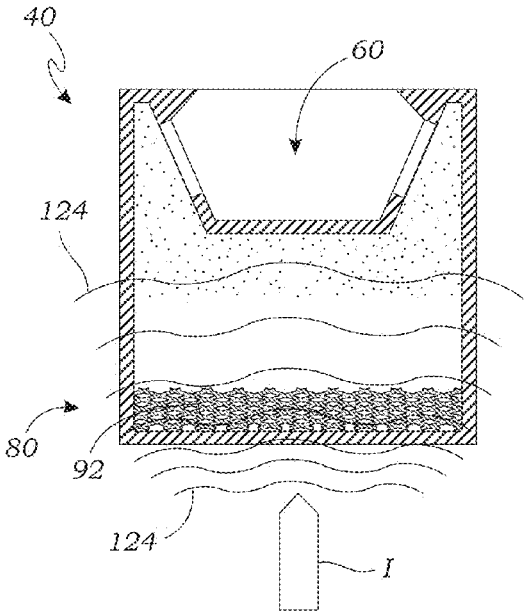
FIG. 11C is a schematic cross-sectional side view of the primer of FIG. 11A, in accordance with at least one embodiment, here in a third mode of operation with the primer not struck or detonated and now disabled.
Figure 11D:
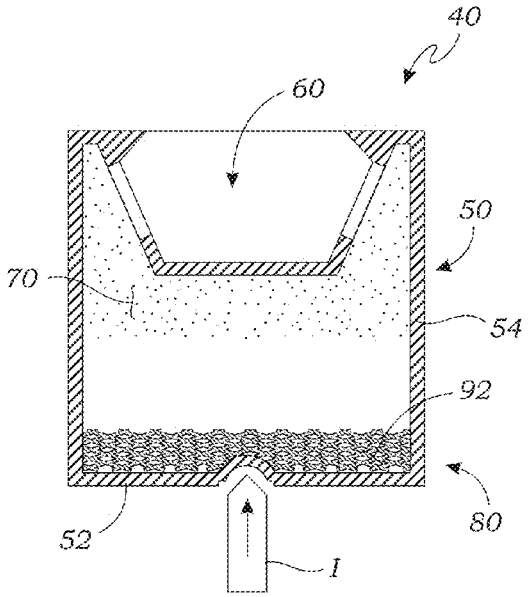
FIG. 11D is a schematic cross-sectional side view of the primer of FIG. 11C, in accordance with at least one embodiment, here in a fourth mode of operation with the primer disabled and then struck and so not detonated.

Referring briefly to FIGS. 11A-11D, there is shown a still further alternative exemplary primer 40 according to aspects of the present invention, here as being similar to that of FIGS. 4A-4D only now employing a lattice 92 as the selectively collapsible or changeable material 80 layer rather than microspheres 82. The lattice 92 is shown as a cross-pattern of generally straight members intersecting substantially perpendicularly, though it will be appreciated that a virtually infinite variety of configurations of such structural lattice 92 may be employed according to aspects of the present invention without departing from its spirit and scope. Those skilled in the art will further appreciate that in any such configuration, the lattice 92 may be of sufficient structural integrity and compressive strength to withstand and transmit mechanical forces and/or vibrational or shock waves induced by the impact of the firing pin I on the primer 40 so as to cause the desired detonation of the primer material 70 under normal operation and firing of the ammunition 20 (FIGS. 3A and 3B) while also being susceptible to selective collapse so as to disable or neutralize the primer 40 and thereby not allow the ammunition 20 to operate normally or be fired. By way of illustration and not limitation, such lattice 92 may be made of a resin, polymer, crystal, or inorganic compound or material or any other such structural material now known or later developed. Similar to the microspheres, any such material may be selected and configured based on its properties and geometrical configuration to be subject to resonance frequency vibration or other such response to select energy waves 124 so as to itself vibrate and fail or collapse. Again, a variety of such lattice 92 configurations are possible according to aspects of the present invention. Once more, the primer 40 has an illustrated overall configuration or defines an "envelope" substantially equivalent to prior art primers P configured for the same or similar cartridge or case C (FIGS. 1 and 2) so as to selectively seat within the primer cavity 26 of the ammunition case 24 to form the finished ammunition 20 (FIGS. 3A and 3B). In a bit more detail, in FIG. 11A, the primer 40 is shown in a first mode of operation with the primer 40 not struck or detonated or disabled, the firing pin I simply being adjacent to the primer 40 in the "ready to fire" position. Again, the selectively collapsible material 80 here configured as lattice 92 may be installed within the bottom of the primer cup 50 adjacent to the bottom wall 52 (FIG. 11B), with the layer of explosive primer material 70 as a solid or semi-solid inserted over and serving to maintain a substantially constant force or retention on the selectively collapsible material 80 layer to further assist in maintaining the relative positions of the components within the primer 40, again regardless of its physical orientation. Referring to FIG. 11B, in a second mode of operation, the primer 40 is now struck and detonated, as by rapidly shifting the firing pin I into the bottom wall 52 of the primer cup 50 (i.e., "firing" the gun). Such action effectively causes a vibrational or shock wave to pass through the primer 40 and/or a crushing force to be applied to the primer 40, here such force being first transmitted through the lattice 92 defining the layer of selectively collapsible material 80, which at this point is not collapsed or deactivated. The "force" can again be a vibrational, shock, or other such energy wave induced by the firing pin I's strike against the primer bottom wall 52 and/or a mechanical force as by even physically lifting the lattice 92 located above the area where the firing pin I struck and mechanically deformed or indented the primer bottom wall 52, in either case such energy or force being transmitted from the firing pin I through the lattice 92 to the primer material 70, thereby crushing or otherwise detonating the primer material 70 and causing an explosive flash that then passes through the one or more openings 62 in the anvil 60 and further through the flash hole 28 into the case 24 so as to ignite the propellant 30 (i.e., gun powder or other such material) and "fire" the bullet 22 (FIGS. 3A and 3B). In the illustrated "Boxer" primer arrangement, it will be appreciated that, specifically, the explosive primer material 70 may be crushed or pinched between the lifted lattice 92 and the bottom wall 64 of the anvil 60, thereby causing the illustrated detonation. Again, along with the lattice 92, small solid particles (not shown) may be added to the layer of selectively collapsible material 80 to further facilitate the energy transfer from the firing pin I to the explosive primer material 70 and thereby help ensure detonation when the ammunition 20 is in its active (non-disabled) state as shown in FIG. 11B. Alternatively, microspheres 82 may be employed in combination with the lattice 92, at the same or different resonance frequencies by design, to further cooperate in selective firing or disabling of the primer 40. In a third mode of operation of the primer 40 of FIG. 11A with it not struck or detonated, it can instead be disabled as shown in FIG. 11C by, for example, passing one or more particular energy waves 124 through the primer 40 that serve to break apart or collapse the lattice 92 or other component(s) comprising the selectively collapsible material 80 that is layered within the primer 40, more about which energy waves is said above in connection with FIGS. 10A-10D and the "science" of the selectively collapsible material 80. As illustrated in FIG. 11C, the energy waves 124 serve to physically collapse the selectively collapsible material 80, here a composite lattice 92, so that it is effectively flattened or breaks apart. The result is one or more gaps or voids throughout what was once a fairly cohesive layer of the selectively collapsible material 80. As best seen in FIG. 11D, then, when the lattice 92 or selectively collapsible material 80 is fully collapsed and settles to the bottom of the primer cup 50, there is a fairly substantial void or gap between what remains of the lattice 92 and the explosive primer material 70. Based on the foregoing discussion in connection with FIGS. 4A-4D and as generally appreciated by those skilled in the art, the primer material 70 being in most cases clay-like, or not a flowable material such as liquid or powder, remains substantially where it was at the upper end of the primer cup 50, or closer to and substantially about the anvil 60, regardless of the orientation of the primer 40. As shown particularly in FIG. 11D, with the primer 40 oriented vertically upward, as when the gun (not shown) is raised or pointed upward, the lattice 92 or other such material may thus have a tendency to sink to or collect on the bottom wall 52 of the primer cup 50; however, where the weapon (not shown) in which the ammunition 20 (FIGS. 3A and 3B) is loaded is pointed downwardly or horizontally, the collapsed lattice 92 may instead collect against the primer material 70 or at one side of the primer 40, in any case there still remaining a mechanical gap between the bottom wall 52 struck by the firing pin I and the primer material 70, such that the selectively collapsible material 80 such as lattice 92 being collapsed renders there no longer a direct mechanical connection between the primer bottom wall 52 and the primer material 70, thereby disabling the primer 40 and hence the ammunition 20 irrespective of any gravitational effects. Once again, in one exemplary embodiment, the lattice 92 or other selectively collapsible material 80 is configured such that the total volume of material in the collapsed state is one-half or less of the total volume within the primer cup 50 bounded by the cup bottom and side walls 52, 54 and the primer material 70 so as to insure that, for example, when the gun (not shown) and hence ammunition 20 and primer 40 are oriented horizontally and the collapsed lattice 92 settles to one side there is still insufficient material to bridge between the primer bottom wall 52 and the primer material 70, thereby ensuring that the primer 40 is disabled (i.e., that the primer material 70 cannot be detonated) and the ammunition 20 cannot be fired. It will again be appreciated that such may be accomplished in a virtually infinite variety of primer arrangements and employing a wide range of selectively collapsible materials (types and arrangements of materials) without departing from the spirit and scope of the invention, such that the further exemplary embodiment of FIGS. 11A-11D is again to be understood as illustrative and non-limiting.

Figure 12A:
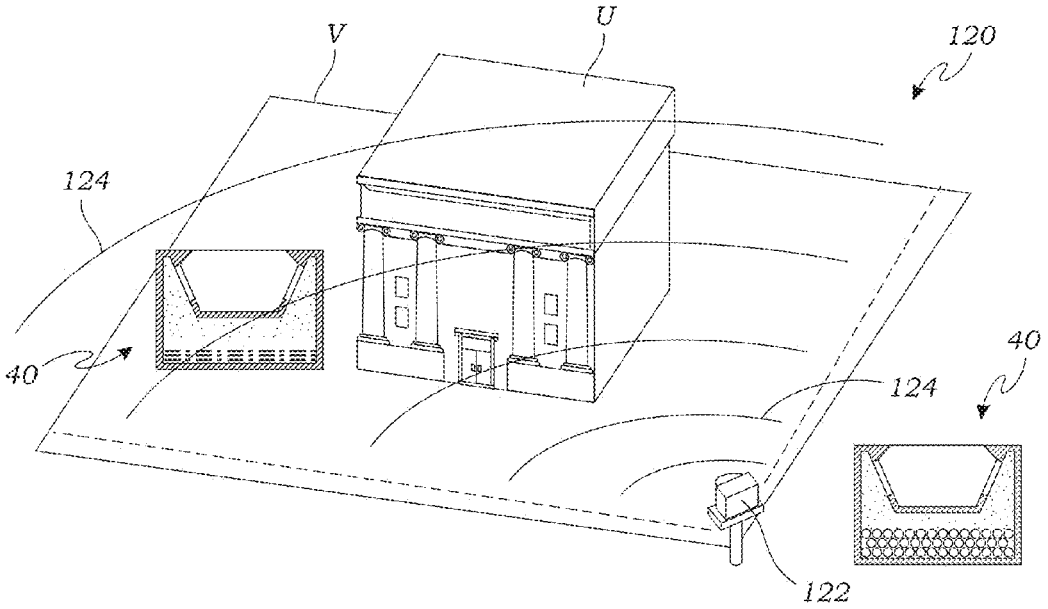
FIG. 12A is a schematic perspective view illustrating an exemplary remote ammunition disabling system, in accordance with at least one embodiment.
Figure 12B:
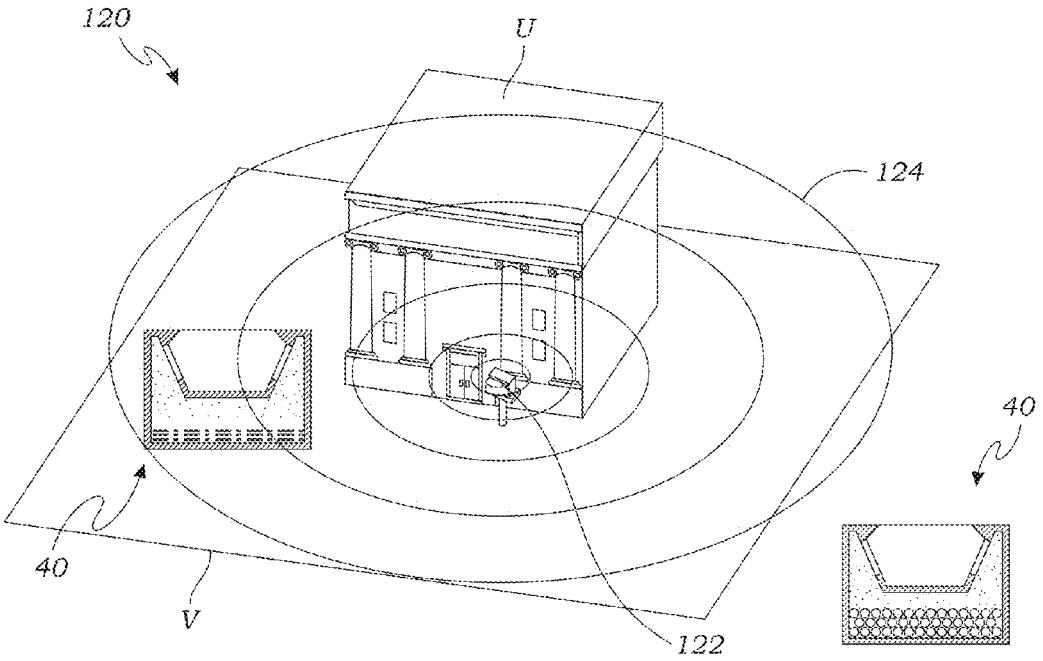
FIG. 12B is a schematic perspective view illustrating an alternative exemplary remote ammunition disabling system, in accordance with at least one embodiment.
Figure 12C:
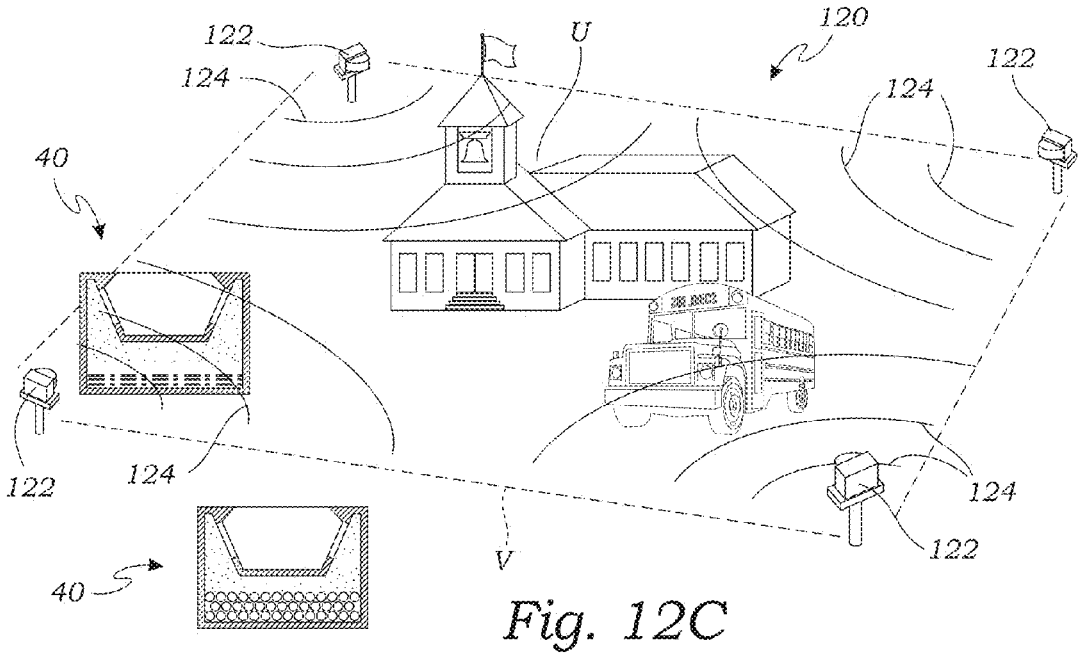
FIG. 12C is a schematic perspective view illustrating a further alternative exemplary remote ammunition disabling system, in accordance with at least one embodiment.
Figure 12D:
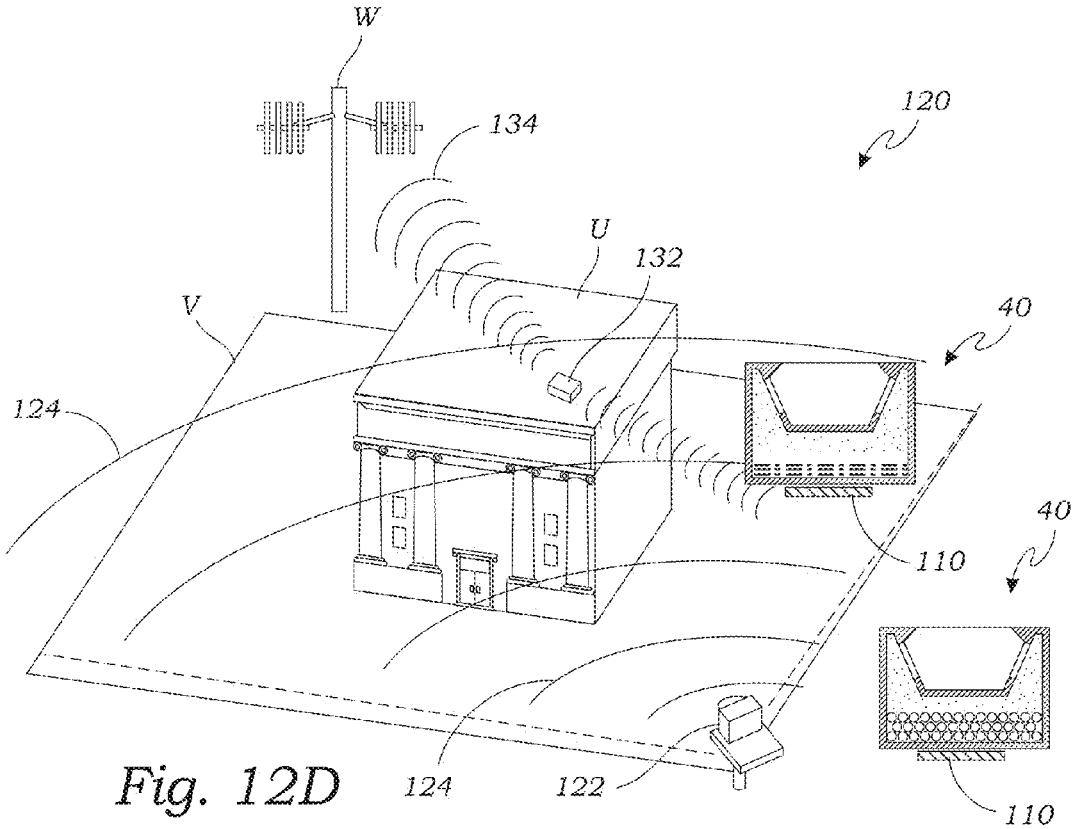
FIG. 12D is a schematic perspective view illustrating a further alternative exemplary remote ammunition disabling system, in accordance with at least one embodiment.

Turning to FIGS. 12A-12D, as a threshold matter it is again to be understood that the general purpose and context for selectively disabling the primer 40 through any such means as shown and described in connection with FIGS. 3-11 hereof is that when a gun (not shown) loaded with ammunition 20 according to aspects of the present invention is carried into certain public or private places equipped with at least one energy wave generator 122, such ammunition 20, and particularly the primer 40 thereof, is thus disabled as described herein, thereby preventing the gun from being fired and potentially saving lives. As referred to herein, an ammunition disabling system 120 according to aspects of the present invention is essentially an ammunition (i.e., bullet) 20 containing a selectively disabled primer 40 combined with at least one energy wave 124 configured to selectively disable the primer 40 and thus the ammunition 20. As shown in FIG. 12A, a first exemplary ammunition disabling system 120 generally comprises one such energy wave generator 122 positioned at a corner of a perimeter V about a building U such as a school, move theater, bank, government or other public service building, medical building, mall or retail store or strip, or the like, such generator 122 being configured to emit energy waves 124 in a somewhat fan pattern typical of a radio wave so as to effectively cover or reach substantially all of the area bounded by the perimeter V and particularly the building U located somewhat centrally within the perimeter V. While a building U is illustrated, it will be appreciated that other public or private places without buildings, such as parks, parking lots, fairgrounds, and the like, may also be protected by an ammunition disabling system 120 according to aspects of the present invention. By way of illustration and not limitation, the energy wave generator 122 may be configured to selectively emit ultrasound energy waves 124 of a particular frequency, such as 1.0 MHz ($10^6$ Hz), which is tuned to or near the resonance frequency (or frequencies of the material 80 or multiple materials 80. It will be appreciated that by having only ammunition 20 (FIGS. 3A and 3B) publicly available that is equipped with primers 40 having a selectively collapsible material 80 (FIGS. 4-11) that is configured having a resonance frequency of approximately 1.0 MHz ($10^6$ Hz) in this example or to otherwise collapse when exposed to energy waves 124 of such a frequency, if a gun loaded with such ammunition 20 were to enter or be carried onto the premises of the building U or come within the perimeter V or protected area so as to be exposed to the energy waves 124 continuously or selectively (periodic or automatically emitted pulses or manually emitted pulses) emitted by the energy wave generator 122, such primer 40 and thus ammunition 20 would thus be disabled as herein described. As illustrated, then, an exemplary primer 40 located outside of the perimeter V is shown as being still activated or not disabled, such as shown in FIG. 4A, while a similar primer 40 brought within the perimeter V is deactivated and disabled and thus unable to be fired as also shown in FIG. 4C. Those skilled in the art will thus appreciate that the incorporation of a primer 40 according to aspects of the present invention in ammunition 20 available on the market results in guns loaded with such ammunition 20 rendered selectively disabled when brought into certain public or gun-free zones for the safety and protection of all those in such places, again such as a school or movie theater where acts of gun violence have been committed historically. As noted above, ultrasonic energy as identified here in the illustrative embodiment is effectively harmless to people and other living things while at the same time having the desired effect of causing the selectively collapsible or changeable material 80 such as a layer of microspheres 82 or a lattice 92 structure to collapse, again disabling the primer 40 and thus the ammunition 20. Even so, for reasons related to wave interference, power savings, or other such factors, it is again noted that the energy waves 124 may be continuous, as in the generator 122 being "always on," or may be selectively emitted as by turning the energy wave generator 122 on if there is concern about a gun threat, such as by a teacher, administrator, staff person, security person or the like noting a suspicious, unauthorized, or visibly armed individual entering the perimeter V. Any such authorized person on the premises could be issued and carry on their person a remote control such as a pendant or the like that enables selective operation of the energy wave generator 122 with the "push of a button," or any such "alarm" could be pulled at select locations within the building U, for example, so as to activate or turn on the generator 122 and thereby neutralize the ammunition 20 in any gun being carried onto the premises within the perimeter V. It will be appreciated that armed security personnel and law enforcement, for example, may still be issued ammunition A (FIGS. 1 and 2) without selectively disabled primers so that such authorized personnel and peacekeepers may still be effectively armed while criminals would not, again, at least within the perimeter V. The same would be true of military-issue ammunition 20 (it would not have selectively disabled primers 40). It will also be appreciated that once primers 40 and related ammunition 20 are disabled, they do not become re-enabled once removed from the premises or taken outside the perimeter V. Rather, it is understood that in the exemplary embodiment the primers 40 once disabled, as by collapsing the selectively collapsible material 80, are irreversibly disabled and rendered permanently neutralized. A gun with such disabled ammunition 20 would simply not fire, as would be the case for any ammunition 20 carried onto the premises within the perimeter V that is equipped with such a selectively disabled primer 40, whether loaded in a gun or not, whereas ammunition 20 even equipped with selectively disabled primers 40 would operate and fire normally if never brought within any such perimeter V or otherwise exposed to the respective disabling energy waves 124. According to further aspects of the present invention, disabled ammunition may be identified as such, for example, by a visible color change on the cartridge. Fundamentally, then, it will be appreciated that according to aspects of the ammunition disabling system 120 of the present invention, individuals using ammunition 20 configured with selectively disabled primers 40 as disclosed herein would have their firearms operate as normal in areas where no energy wave generators 122 are operational, whereas in areas where such generators 122 are present and operational, no firearms would function except those of law enforcement. Accordingly, the guns of private citizens even when shooting ammunition 20 that may be selectively disabled according to aspects of the present invention would generally operate conventionally when shooting recreationally such as at a range or when out hunting and at their homes in self-defense, but again not when brought onto a premises having an operational energy wave generator 122 as herein described, such as a "gun-free" public place. To address the potential concern of a criminal attempting to disable a homeowner's gun, all generators 122 may be configured to run on AC or non-portable power only and/or may be configured with coded or secret frequencies not easily "reverse engineered." Conversely, law enforcement could have mobile generators 122 not available to the general public in order to disable criminals' guns, assuming they are loaded with ammunition 20 having selectively disabled primers 40. Any mounted energy wave generator 122 as illustrated in FIG. 12A may be installed in any desired location and at any height so long as the wave propagation effectively covers the desired area down to ground level. Specifically, while shown in the exemplary embodiments as being outside the illustrated buildings U, it will be appreciated that such energy wave generators 122 may be positioned inside any such buildings U as well that is, the one or more generators 122 may be outside of a building U, inside the building U, or both. The generator 122 may operate on AC, DC, solar, or other power source now known or later developed and in addition to "always on" or remote control operation may also be equipped in certain instances with motion detection technology and the like for selectively powering on. Those skilled in the art will appreciate that any such technology now known or later developed may be employed in the present invention without departing from its spirit and scope. Again, a single generator 122 may be employed in some situations, generating one or more frequencies as desired, or multiple generators 122 may be employed, each generating one or more frequencies. As shown in FIG. 12B, as an alternative, a single energy wave generator 122 may instead be installed substantially centrally within the perimeter V or basically adjacent to the building U, particularly at an entrance or point of ingress. As illustrated, such a generator 122 would here emit a radial or circular wave pattern 124 that still substantially covers the area within the perimeter V, or such waves 124 may only emanate immediately about such entrance to effectively form an invisible "protective curtain" at such point of ingress while otherwise not affecting a wider area. Again, a primer 40 brought within the perimeter V or toward the entrance nearer to the generator 122 would be disabled as illustrated, while a primer 40 that remains away from the entrance or outside the perimeter V and the effective radius of the generator 122 would not be disabled. By way of further example, with reference now to FIG. 12C, there is illustrated a relatively larger building U or building complex that is essentially of too great a size or over too great an area for one energy wave generator 122 to cover, which units may have an effective range of on the order of half a mile, for example. Accordingly, as shown, four energy wave generators 122 may be positioned at corners of the building U or premises so as to establish a virtual perimeter V thereabout. As illustrated, each such generator 122, as in FIG. 12A, may emit a broad or narrow fan-shaped wave 124 that together cover substantially the entire area within the perimeter V, including the building U or campus, particularly its exteriors and thus points of ingress. Accordingly, as again illustrated, a primer 40 brought within the perimeter V or toward one of the buildings U would be disabled as illustrated, while a primer 40 that remains away from the building U complex or outside the perimeter V and the effective area covered by the illustrated four generators 122 would not be disabled. Those skilled in the art will appreciate that such number and positioning of the energy wave generators 122 is exemplary and non-limiting. Referring finally to FIG. 12D, there is shown yet another exemplary ammunition disabling system 120 according to aspects of the present invention, here again having a single corner-positioned, fan-shaped wave 124 emitting generator 122 to protect an area within a perimeter V including a building U, much like the embodiment of FIG. 12A, only now further including an electromagnetic transmitter 132 or the like configured to send and receive such signals. Particularly, in the illustrated embodiment, all primers 40 may be further equipped with a detector strip 110 that when in the presence of the transmitter 132 or transceiver is wirelessly detected and communicates identifying information relative to the ammunition 20 or particularly the primer 40, somewhat analogous to serialization or other traceability or trackability technologies now known or later developed. The detector strip 110 may be positioned anywhere on the primer 40 or alternatively on or in the ammunition case 24. As illustrated, the identifying detector strip 110 associated with a primer 40 that has come within the perimeter V, whether disabled yet or not, communicates wirelessly with the transmitter 132, shown for illustrative purposes as located on the roof of the building U, the transmitter 132 in turn communicating with a broadcast tower W and thus over a wide area network as now known or later developed so as to alert law enforcement, on-site security or management personnel, or other such interested parties of the presence of an unauthorized weapon or ammunition 20 within the vicinity of the building U. It will be appreciated that any network and related hardware and communication protocol now known or later developed, including but not limited to cellular, satellite, Wi-Fi, Bluetooth, or the like, may be employed in such complimentary identification and notification functionality as enabled by the detector strip 110 and transmitter 132. Again, those skilled in the art will appreciate that a variety of configurations and locations of both the detector strip 110 and transmitter 132 are possible according to aspects of the present invention without departing from its spirit and scope.

In many applications, there may be line-of-sight issues, where the energy wave 124 is unable to reach and affect the material 80 within the ammunition due to obstructions positioned between the ammunition and the energy wave generator 122, such as a wall or other similar obstruction. Although the energy waves 124 are illustrated as being emitted over a circular (360 degree) or wide angle (fan-shaped) pattern, the beams produced by many of the transducers, magnetrons, etc. used in the energy wave generator 122 are narrowly focused over a small angle. Thus, the energy wave generator 122 can be mounted on a rotating or oscillating base to sweep the area with an energy wave 124 beam, producing, in effect, a fan or circular pattern. The energy wave generator 122 can be mounted on a linear or curvilinear track or the like to enable travel along the path to reorient the energy wave source (such as a magnetron or a transducer), optionally including rotation as the energy wave generator 122 travel along the track. Further, two or more energy wave generators 122 can be mounted in a cluster (back-to-back, radial, or other arrangement) with each energy wave generator 122 aimed outwardly in adjacent, closely or nearly adjacent, or overlapping energy wave 124 cones, to produce a plurality of energy waves 124 that provide coverage over a broad or circular angle. The cluster of energy wave generators 122 can also be rotated or oscillated. The energy wave generator 122 can be mounted on the ceiling or wall of the building on a track or otherwise mounted, to cover blind areas (somewhat similar to providing WI-FI coverage within and around buildings). The energy wave generator 122 may be focused, collimated, or directed to provide a focused wave. For example, a hand-held unit may be directed manually toward the ammunition or shooter by sight or laser sight. The mounted energy wave generator 122 can automatically or manually be directed to the ammunition, such as by detecting the infrared signal through use of a detector and targeting the heat source. In one example, the energy wave generator 122 is mounted around a door opening (or other constricted point of entry, exit, or transition), with a first energy wave generator 122 directed downward toward the opening and a second energy wave generator 122 directed horizontally toward the opening (transverse to the first energy wave generator 122). The energy wave generator 122 can be mounted to travel linearly along a path, oscillate through an angular sweep, or rotate through a full circle. Further, the energy wave generator 122 can be mounted to an unmanned aerial vehicle (drone). The energy wave generator 122 can be comprised of phased array transducers. Additionally, the energy wave generator 122 can be remotely activated. Moreover, the structures or portions of the structures may be arranged, designed, and utilized to facilitate or guide the propagation of the energy wave 124 into blind areas (areas not normally covered by the energy wave 124), such as using a radio or other energy reflective surface or other devices or amplifiers or means to redirect the energy waves 124 toward an area, through use of reflection, refraction, diffraction, echo effects, and so on.

Looking now at FIGS. 13-16, four alternate embodiments of the present ammunition disabler are shown. Instead of the selectively changeable material 80 being positioned within primer cup 50, the material 80 is positioned externally from the primer cup 50, either being contained within a separate material cup 46, positioned within the primer cavity 26 between the primer cup 50 and a barrier 48 that encloses the primer cavity 26, or simply inserted or layered on the bottom wall 52 of the primer cup 50. FIG. 13 illustrates an embodiment where the material 80 is a grouping of microspheres either held within the primer cavity 26 by the barrier 48 or adhered in place without the barrier 48 (not shown) where the microspheres 82 may be adhered to one another and/or the primer cavity 26 or may be suspended within a matrix held within the primer cavity 26. The barrier 48 may be any material or configuration which protects the material 80, permits the percussion of the firing pin I to be transmitted to the material 80 without substantial hindrance, and permits sufficient passage of the energy wave 124 therethrough to permit selective destruction of at least a portion of the material 80. Although a barrier 48 or some other membrane is preferred, it is not required. The barrier 48 is preferably made of plastic (polymer), paper, or other material, material configuration, or material thickness substantially transparent to the energy waves (allowing sufficient passage to permit disablement).

FIGS. 13-16 further illustrates a primer cup 50 having a reduced overall height H1 (see FIG. 9B) (compared to the primer cups illustrated in earlier-described embodiments or a standard primer cup) to permit the insertion of the selectively changeable material 80, while maintaining a combined seating depth within the primer cavity 26 slightly below flush. Alternatively, a standard sized primer cup 50 may be used, where the primer cavity 26 is bored slightly deeper within the case 24 (preferably less than 1 mm) to provide additional depth to place the material 80 behind the primer cup 50, with the material 80 situated at or near the opening of the primer cavity 26 with the primer cup 50 situated beneath the material 80 and at or near the bottom of the bore defining the primer cavity 26.

FIG. 14 illustrates yet another embodiment of the present ammunition disabler, where the selectively changeable material 80 is contained within a separate material cup 46, which may be pressed or adhered into the primer cavity 26 atop the primer cup 50. The exemplary material cup 46 is illustrated as a complete enclosure that completely seals the material 80 (microspheres 82 is this example) within the material cup 46. However, the material cup 46 may be configured to partially enclose the material 80 instead; for example, the innermost wall of the material cup 46 (closest to the bottom wall 52 of the primer cup 50) may be fully or partially excluded so that the material 80 directly contacts the bottom wall 52 or is in close proximity thereof. Much like the barrier 48, the material cup is preferably made of a material or of a configuration that permits sufficient passage of the energy wave 124 therethrough, such as being made of a polymer material, a thin material, a material with perforations or strategic openings that permit entry of the energy waves 124. Referring back to the embodiments of the invention that position the material 80 within the primer cup 50, the walls of the primer cup 50 and/or at least a portion of the ammunition case 24 may also be made of a material (polymer, etc.) that that permits sufficient passage of the energy wave 124 therethrough which enables the disrupting the mechanical structure of the selectively changeable material 80 without the case 24 or the primer cup 50 unduly shielding the material 80. Furthermore, current firearms and necessarily have designed-in apertures which permit ingress of the energy waves 124, continuously or during certain actions and movements of the firearm or accessories, such as the witness holes in the ammunition magazine, the ejection port, gaps between parts, such as the gap between the cylinder and the frame or when the cylinder of a revolver is rotated to the open position to expose the chambers for reloading, and other openings inherent to the design of the firearm or as the user is transferring the ammunition to the firearm. Further, ammunition in pouches or other storage may also be disabled before they are loaded. Moreover, even if a first shot is discharged, as the spent case is being ejected through the ejection port, the following round or multiples successive rounds of ammunition may be exposed to the energy waves 124 for a sufficient time to disable the ammunition. Even if only one round of ammunition is disabled, this will likely cause the firearm to jam or at least require a much slower manual extraction of the disabled ammunition, thus slowing the overall rate of fire. Thus, the material 80 can be exposed to the energy waves 124 in numerous conditions, such as when loading the magazine, inserting the magazine into the firearm, retracting the slide, discharging the spent cartridge, loading a revolver, and through any temporary or permanent apertures within the firearm.

The example embodiments of FIGS. 15-16 illustrate the embodiments similar in some respects to that of FIGS. 13-14, respectively, except the material 80 is not a grouping of microspheres. Instead, the material could be is solid, hollow, gas-filled, or other structure, such as a plate, a disk, a slug, a column, a coating, a plurality of microspheres, a plurality of particles, a lattice, a compacted material, a solid material, or a loosely packed material. Further, the above-described embodiments, such as those illustrated in detail in FIGS. 3A-B, 4A-D, 5A, 6A-B, 7A-C, 8A-B, 9B-C, and 11A-D, can be modified to replace the microspheres with the material 80 of FIGS. 15-16, except the material 80 would be located inside the primer cup 50 rather than outside. The hatching in FIGS. 15 and 16 schematically represents a material 80 that is not a grouping or layer or plurality of microspheres. The barrier 48 shown in FIG. 15 would be similar to the barrier 48 of FIG. 13, and would serve to at least protect the material 80, and thus the primer material 70 from inadvertent impacts, and may also serve to hold the material 80 within the primer cavity 26. The material cup 46 is similar to the material cup 46 shown in FIG. 14, except the material 80 would not be microspheres 82.

Figure 17A:
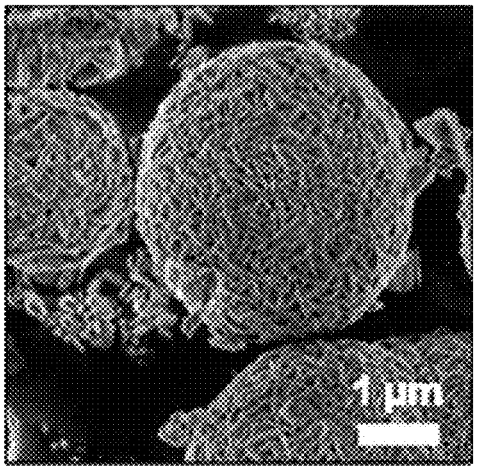
FIG. 17A is a microscopic image of nickel oxide microspheres before exposure to ultrasound.
Figure 17B:
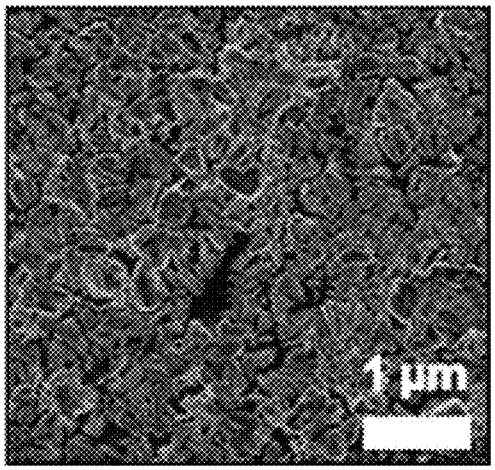
FIG. 17B is a microscopic image of nickel oxide microspheres after exposure to ultrasound within an acoustic gel medium.

Several experiments were carried out to determine the how various energy waves change the structural integrity of the exemplary sample of material which may comprise the present changeable material 80. The images of the various samples before and after exposure to the energy waves was taken using a FEI NOVA 600 scanning electron microscope. In a first series of experiments, a sample was exposed to ultrasound through an acoustic gel medium for the purpose of testing the sample under near-ideal conditions. The experimental setup included a QSONICA Q500 ultrasound transducer emitting an ultrasound signal at a frequency of 20 kHz with a power output of 100 W utilizing a piezoelectric convertor/transducer for producing a mechanical vibration in the acoustic gel. The sample was placed 2 mm from the tip of the probe, with the acoustic gel providing a medium through which the ultrasonic mechanical vibrations can travel from the probe to the sample. FIG. 17A is a microscopic image of nickel oxide microspheres before exposure to ultrasound; and FIG. 17B is a microscopic image of nickel oxide (NiO) microspheres after approximately 1 minute of exposure to ultrasound. It can be seen that the nickel oxide microspheres are whole in FIG. 17A with the shells unbroken and the structural integrity intact. After exposure to the ultrasound energy, it can be seen in FIG. 17B that the shells of the microspheres have been burst open, fractured, and structurally changed to a material that would absorb a percussive impact and/or would create a substantial gap between the firing pin and priming compound due to the reduction in overall volume of the microspheres. The microscopic image illustrates the result that there were no microspheres visible in the sample after exposure to the ultrasound.

Figure 18A:
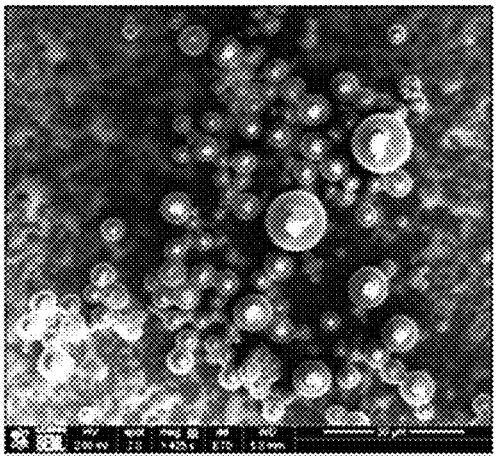
FIG. 18A is a microscopic image of polyvinylidene fluoride microspheres before exposure to ultrasound.
Figure 18B:
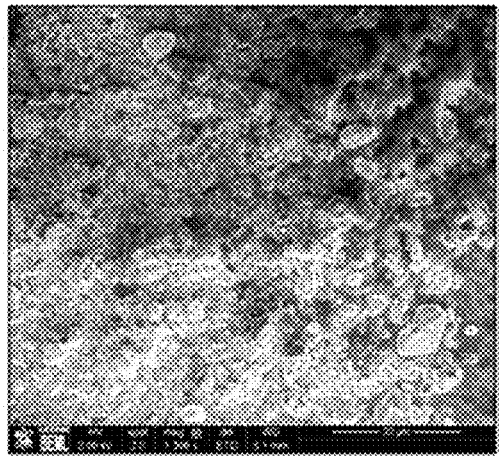
FIG. 18B is a microscopic image of polyvinylidene fluoride microspheres after exposure to ultrasound within an acoustic gel medium.

Under the same conditions, polyvinylidene fluoride microspheres were exposed to the ultrasound. FIG. 18A illustrates the polyvinylidene fluoride microspheres before exposure to ultrasound; and FIG. 18B illustrates the polyvinylidene fluoride microspheres after exposure to ultrasound. When comparing the two images, it can be seen that, in FIG. 18B, the microspheres have been burst open and fragmented. Thus, this indicates that the microspheres are structurally changed to a material that would absorb a percussive impact and/or would create a substantial gap between the firing pin and priming compound due to the reduction in individual and overall volume of the material, or a parting, cleaving, or other displacement of the material. The nickel oxide (NiO) may be manufactured by known techniques described by "Fabrication of β-Ni(OH)2 and NiO hollow spheres by a facile template-free process", Chemical Communications, Issue 41, (Sep. 20, 2005), pp. 5231-5233, Wang, et al., which is herein incorporated by reference in its entirety.

Figure 19A:
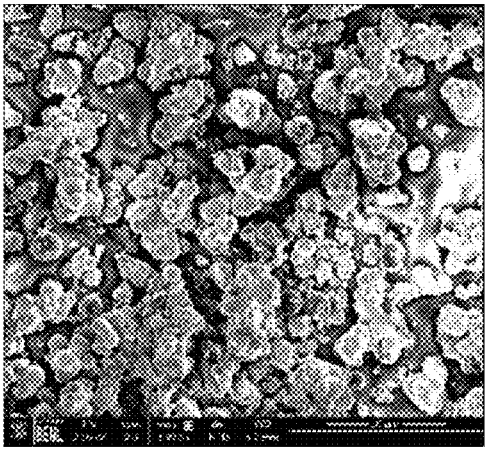
FIG. 19A is a microscopic image of polystyrene coated lead zirconium titanate microspheres before exposure to microwave energy.
Figure 19B:
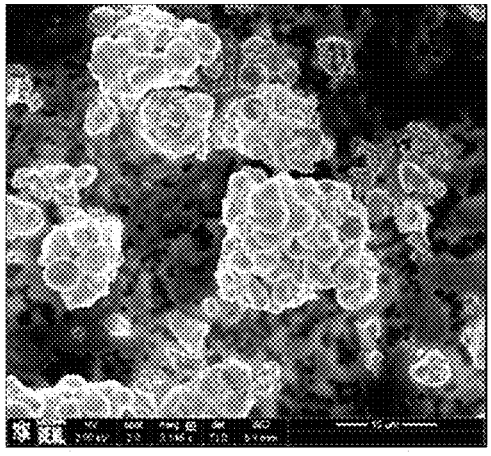
FIG. 19B is a microscopic image of the polystyrene coated lead zirconium titanate microspheres after exposure to microwave energy across an air gap.

Further tests were conducted using a CEM MARS 5 research grade microwave digester with a 1200 W magnetron at a frequency of 2455 mHz. A 5.0 mg sample of material was placed suspended in the center of the oven on a PYREX plate at a distance of 15.25 cm (air gap) from the magnetron and exposed to two 30 second pulses of microwave energy at 600 W. FIG. 19A illustrates a polystyrene coated lead zirconium titanate microspheres sample (PZT ceramic) before exposure to microwave energy. It can be seen in FIG. 19A that most if not all of the microspheres are closely grouped together which enables the transmission of a percussive wave through the grouping. After exposure to the microwave energy, as shown in FIG. 19B, the microspheres sinter or aggregate into small groups with the groups separated by large spaces. Again, the large spaces would inhibit transmission of the percussive wave through disruption of the overall mechanical integrity of the material. Under the same conditions, nickel oxide microspheres are exposed to microwave energy over an air gap.

Figure 20A:
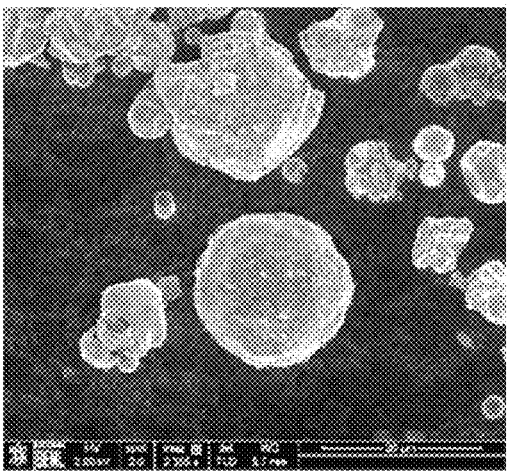
FIG. 20A is a microscopic image of nickel oxide microspheres before exposure to microwave energy.
Figure 20B:
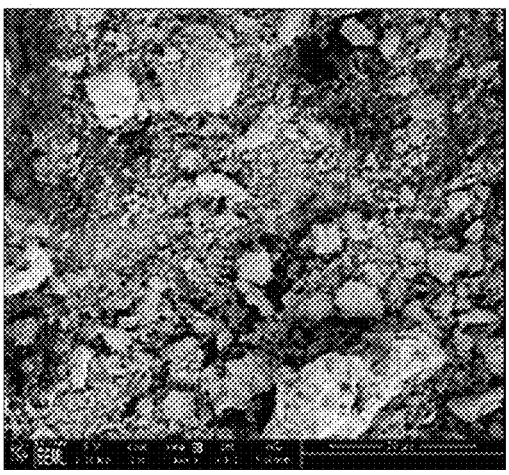
FIG. 20B is a microscopic image of the nickel oxide microspheres after exposure to microwave energy across an air gap.

FIG. 20A illustrates the nickel oxide microspheres before exposure to microwave energy, under similar conditions as described in reference to FIGS. 19A-B, where the grouping or plurality of microspheres together are structurally capable of transmitting a percussive wave from the firing pin to the primer material for detonating the primer material. FIG. 20B shows the nickel oxide microspheres after exposure to the microwave energy over an air gap. The nickel oxide microsphere structure is at least in part fragmented and crumbling. Instead of transmitting the percussive wave, the crumbled material tends to absorb and deaden the impact from the firing pin, even if the entire thickness of the nickel oxide microsphere structure is not crumbled and mechanically degraded, so long as a sufficient thickness at the firing pin striking point is degraded, the priming compound will fail to ignite.

The present material 80 (whether it be nickel oxide or some other responsive material) may be integrated into the construction of the primer cup 50, instead of being positioned externally or internally. For example, the bottom wall 52 may be made wholly or in part from the selectively changeable material 80 (such as a sheet or plate material); or the entire primer cup 50 may be made out of the selectively changeable material 80. In one example, portions of the primer cup 50 and/or the case 24 can be made of a polymer or other material that is radio-transparent or radio-translucent to the energy waves 124 to permit sufficient passage of the energy waves 124 to permit a mechanical change in the material 80, such as a nonmetallic material and the like.

Figure 21A:
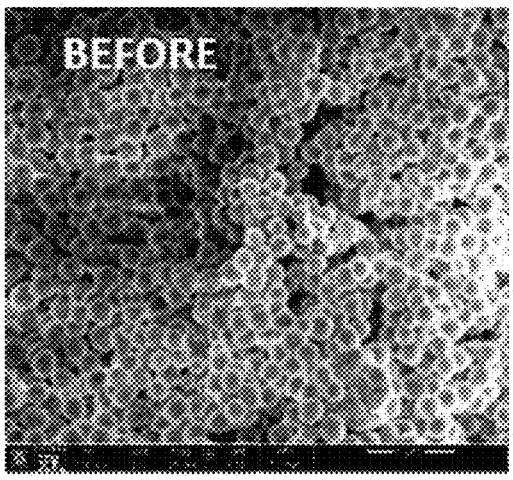
FIG. 21A is a microscopic image of polyvinylidene fluoride microspheres before exposure to microwave energy.
Figure 21B:
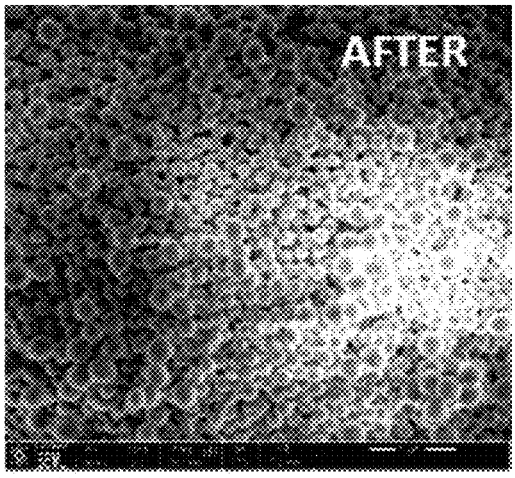
FIG. 21B is a microscopic image of the polyvinylidene fluoride microspheres after exposure to microwave energy across an air gap.

Under the same experimental conditions as the materials of FIGS. 19A-B and 20A-B, polyvinylidene fluoride microspheres are exposed to microwave energy. FIG. 21A illustrates the polyvinylidene fluoride microspheres before exposure to microwave energy; and FIG. 21B illustrates the polyvinylidene fluoride microspheres after exposure to microwave energy across an air gap. Comparing FIG. 21A with FIG. 21B, measurements indicate a 10% reduction is size when comparing the sum of contiguous diameters of the microspheres before and after exposure. This 10% reduction is sufficient to create a gap within or around the material to disrupt the mechanical link between the firing pin and the priming compound.

Although final result of exposure to the energy wave 124 is shrinkage, fragmenting, bursting, or other mechanical degradation, the destruction may be caused by a chemical process induced by the energy wave 124. For example, in the experiments testing the polystyrene and the polyvinylidene fluoride microspheres, a swelling of the microspheres was observed prior to shrinkage and/or bursting, which is possibly indicative of chemical change and a breaking of chemical bonds. Furthermore, the materials and experimental conditions in the above-described experiments could be integrated with the teachings of the embodiments of the present ammunition disabler, the material 80, the ammunition 20, primer cup 50, and/or material cup 46, such as the power ranges, the frequencies, and other experimental settings.

Aspects of the present specification may also be described as follows:

1. A selectively disabled ammunition having a primer comprising: a cup having a bottom wall and a side wall and configured to contain a quantity of explosive primer material; and a selectively collapsible material positioned within the cup adjacent to the primer material.

2. The primer of embodiment 1 wherein the selectively collapsible material is positioned between the bottom wall and the primer material.

3. The primer of embodiment 1 or embodiment 2 wherein: an anvil is positioned within the cup substantially opposite the bottom wall; and the selectively collapsible material is positioned between the bottom wall and the anvil.

4. The primer of embodiment 3 wherein the selectively collapsible material is positioned between the bottom wall and the primer material.

5. The primer of embodiment 3 or embodiment 4 wherein the anvil is installed integrally with the cup so as to protrude substantially downwardly within the cup toward the bottom wall.

6. The primer of any of embodiments 3-5 wherein the anvil is formed having at least one opening for selective communication of the primer material outside of the cup.

7. The primer of embodiment 6 wherein the primer is configured to be received within a primer cavity of a case of the ammunition containing a propellant, whereby the primer material selectively communicates with the propellant through the opening in the anvil and an at least one flash hole formed in the case.

8. The primer of any of embodiments 3-7 further comprising a shock-absorbing layer positioned adjacent to the anvil between the anvil and the bottom wall.

9. The primer of embodiment 8 wherein the shock-absorbing layer comprises microspheres.

10. The primer of any of embodiments 1-9 wherein the bottom wall and the side wall define a cup profile that substantially corresponds to a primer cavity of the ammunition.

11. The primer of any of embodiments 1-10 wherein in a first or second mode of operation of the ammunition the selectively collapsible material mechanically bridges between the bottom wall and the primer material, whereby an impact to the bottom wall from a firing pin is transmitted to the primer material via the selectively collapsible material.

12. The primer of any of embodiments 1-11 wherein the cup defines a height in the range of 2.50 mm to 3.25 mm and the selectively collapsible material defines a layer having a nominal height within the cup in the range of 0.50 mm to 2.50 mm.

13. The primer of any of embodiments 1-12 wherein the selectively collapsible material is substantially in contact with the primer material.

14. The primer of any of embodiments 1-13 wherein in a third or fourth mode of operation of the ammunition the selectively collapsible material forms a gap within the primer, whereby an impact to the bottom wall from a firing pin is not transmitted to the primer material.

15. The primer of embodiment 14 wherein the gap is formed between the bottom wall and at least a portion of the primer material.

16. The primer of embodiment 14 or embodiment 15 wherein the cup defines a height in the range of 2.50 mm to 3.25 mm and the selectively collapsible material defines a layer having a nominal height within the cup in the range of 0.10 mm to 1.25 mm, whereby the gap is nominally in the range of 0.40 mm to 2.40 mm.

17. The primer of any of embodiments 1-16 configured as a centerfire Boxer-type primer.

18. The primer of any of embodiments 1-16 configured as a centerfire Berdan-type primer.

19. The primer of any of embodiments 1-16 configured as a Rimfire-type primer.

20. The primer of any of embodiments 1-19 further comprising a support washer positioned between the selectively collapsible material and the primer material.

21. The primer of embodiment 20 wherein the support washer comprises at least one through-hole.

22. The primer of embodiment 20 or embodiment 21 wherein the cup is formed having an inwardly-projecting support lip formed on the side wall so as to selectively support the support washer.

23. The primer of any of embodiments 1-22 wherein the primer material is selected from the group consisting of lead (Pb) azide, lead (Pb) styphnate, lead (Pb) thiocyanate, barium nitrate, antimony trisulfide, powdered aluminum, powdered tetrazene, potassium perchlorate, diazodinitrophenol (DDNP), fulminated mercury, and any combination thereof.

24. The primer of any of embodiments 1-23 wherein the primer material is a solid or semi-solid.

25. The primer of any of embodiments 1-24 wherein the selectively collapsible material is configured to collapse when exposed to an energy wave.

26. The primer of any of embodiments 1-25 wherein the selectively collapsible material comprises one or more microsphere.

27. The primer of embodiment 26 wherein the microsphere has a nominal outside diameter in the range of approximately one micron to one thousand microns (1-1,000 μm or 0.001-1.0 mm).

28. The primer of embodiment 27 wherein the microsphere more preferably has a diameter of approximately ten microns to five hundred microns (10-500 μm or 0.01-0.50 mm).

29. The primer of any of embodiments 26-28 wherein the microsphere has a nominal wall thickness in the range of approximately a quarter micron to twenty microns (0.25-20 μm).

30. The primer of any of embodiments 26-29 wherein the microsphere is formed from a material selected from the group consisting of glass, ceramic, polymer, polyethylene, polystyrene, thermoplastic, hydrogel, and any combination thereof.

31. The primer of any of embodiments 26-30 wherein the microsphere is hollow.

32. The primer of any of embodiments 26-31 wherein the microsphere is filled with air.

33. The primer of any of embodiments 26-31 wherein the microsphere is filled with an inert gas.

34. The primer of embodiment 33 wherein the inert gas is selected from the group consisting of carbon dioxide ($CO_2$), nitrogen ($N_2$), hydrogen ($H_2$), helium (He), neon (Ne), argon (Ar), krypton (Kr), xenon (Xe), bromine (Br), dilithium (Dt), and any combination thereof.

35. The primer of any of embodiments 1-25 wherein the selectively collapsible material comprises a lattice.

36. The primer of embodiment 35 wherein the lattice is formed from a material selected from the group consisting of resin, polymer, crystal, inorganic compound, and any combination thereof.

37. The primer of any of embodiments 1-36 wherein the selectively collapsible material is configured to collapse to a height fifty percent (50%) or less of that of the selectively collapsible material in its uncollapsed state.

38. The primer of any of embodiments 1-37 further comprising one or more metal fiber positioned within the selectively collapsible material.

39. The primer of any of embodiments 25-38 wherein the energy wave is selected from the group consisting of ultrasound waves, infrasound waves, long wave radio waves, medium wave radio waves, short wave radio waves, microwaves, terahertz waves, and any combination thereof.

40. The primer of any of embodiments 25-39 wherein the energy wave is in the frequency range of approximately $10^3$ Hz to $10^{14}$ Hz.

41. The primer of any of embodiments 25-40 wherein the selectively collapsible material has a resonance frequency and the energy wave has a frequency substantially equivalent to the resonance frequency.

42. The primer of any of embodiments 25-41 wherein the energy wave is sourced from at least one energy wave generator.

43. The primer of embodiment 42 wherein the energy wave generator is positioned near a building so as to define a perimeter about the building.

44. The primer of any of embodiments 1-43 further comprising a detector strip configured to interface with a transmitter.

45. An ammunition disabling system comprising an ammunition having a primer as defined in any of embodiments 1-44.

46. The ammunition disabling system of embodiment 45 further comprising at least one energy wave generator.

47. The ammunition disabling system of embodiment 46 wherein the energy wave generator emits waves at a single frequency.

48. The ammunition disabling system of embodiment 46 wherein the energy wave generator emits waves at multiple frequencies.

49. The ammunition disabling system of embodiment 46 wherein multiple energy wave generators emit waves at a single frequency.

50. The ammunition disabling system of embodiment 46 wherein multiple energy wave generators emit waves at multiple frequencies.

51. The ammunition disabling system of any of embodiments 46-50 wherein the energy wave generator is positioned a distance from a building so as to define a perimeter about the building.

52. The ammunition disabling system of any of embodiments 46-51 wherein the energy wave generator is positioned immediately adjacent to an entrance to a building.

53. The ammunition disabling system of any of embodiments 46-52 wherein the energy wave generator is substantially constantly powered.

54. The ammunition disabling system of any of embodiments 46-52 wherein the energy wave generator is selectively powered.

55. The ammunition disabling system of any of embodiments 45-54 further comprising at least one transmitter for detection of a detector strip of the primer and transmitting related information obtained from the detector strip.

56. A method of employing an ammunition having a primer as defined in any of embodiments 1-44, the method comprising the steps of: (a) installing the primer in the ammunition; and (b) disabling the primer.

57. The method of embodiment 56, wherein the step of installing the primer comprises inserting the primer within a primer cavity of the ammunition.

58. The method of embodiment 56 or embodiment 57, wherein the step of disabling the primer comprises exposing the primer to an energy wave so as to collapse a selectively collapsible material of the primer.

59. The method of embodiment 58, wherein the step of exposing the primer to an energy wave comprises transporting the ammunition within a perimeter.

60. The method of embodiment 58 or embodiment 59, wherein the step of exposing the primer to an energy wave comprises emitting the energy wave from an energy wave generator.

61. The method of embodiment 60, wherein the step of emitting the energy wave from an energy wave generator is selectively controlled.

62. Use of an ammunition having a primer as defined in any of embodiments 1-44 to selectively disable the ammunition.

63. The use according to embodiment 62, wherein the use comprises an ammunition disabling system as defined in any of embodiments 45-55.

64. The use according to embodiment 62 or embodiment 63, wherein the use comprises a method as defined in any of embodiments 56-61.

65. An ammunition disabler responsive to an energy wave for selectively disabling ammunition is provided, and generally includes a material selectively changeable from an operative state to a deactivated state upon exposure to the energy wave, the material being positioned between the firing pin and the priming compound when the ammunition is chambered within the firearm; wherein, when the material is in the operative state, the material is capable of forming a mechanical link between the firing pin and the priming compound so that the percussion wave from the firing pin is transmitted through the material to ignite the priming compound when the firing pin is activated; and wherein, when the material is in the deactivated state, the degradation of the material disrupts the mechanical link and inhibits transmission of the percussion wave through the material to prevent ignition of the priming compound.

66. The ammunition disabler of embodiment 65 where the priming compound is contained within a primer cup comprising a bottom wall, a side wall, and an anvil.

67. The ammunition disabler of one or both the embodiments 65-66 where the material is contained within the primer cup between the bottom wall and the priming compound.

68. The ammunition disabler of embodiment 65 where the material is contained outside the primer cup.

69. The ammunition disabler of one or both the embodiments 65 or 68 where the material is contained within a material cup, the material cup positioned adjacent to the bottom wall of the primer cup.

70. The ammunition disabler of one or all of the embodiments 65, 68, or 69 where one or both of the primer cup and the material cup are made of a nonmetallic material.

71. The ammunition disabler of one or more of the embodiments 65, 68, 69-70 where the primer cup is made of polymer.

72. The ammunition disabler of one or more of the embodiments 65-71 where the material comprises one or any combination of a nickel oxide material, a polyvinylidene fluoride material, a polystyrene coated lead zirconium titanate material, a glass material, a ceramic material, a polymer material, a polyethylene material, a polystyrene material, a thermoplastic material, a resin material, a crystal material, an inorganic compound material, a clay material, or a hydrogel material.

73. The ammunition disabler of one or more of the embodiments 65-72 where the material is structurally configured as one or more of a plate, a disk, a slug, a column, a coating, a plurality of microspheres, a grouping of microspheres individually or entirely coated with a coating material, a plurality of particles, a lattice, a compacted material, or a loosely packed material.

74. The ammunition disabler of one or more of the embodiments 65-73 where the material degrades from the operative state to the deactivated state through one or more of a reduction in size of at least some of the material, a collapsing of at least some of the material, a fracturing of at least some of the material, an aggregation of at least some of the material, a sintering of at least some of the material, a bursting of at least some of the material, a chemical reaction in at least some of the material, or breakage of at least some of the material.

75. The ammunition disabler of one or more of the embodiments 65-73 where the material degrades from the operative state to the deactivated state by continuous or pulsed exposure to the energy wave, the energy wave comprising one or any combination of an ultrasound wave, a microwave, an infrasound wave, a long wave radio wave, a medium wave radio wave, a short wave radio wave, or a terahertz wave.

76. The ammunition disabler of at least the embodiment 75 where an ultrasound frequency of the ultrasound wave is varied between one more ultrasound frequencies resonant to the material.

77. The ammunition disabler of at least the embodiment 75 where a microwave frequency of the microwave is varied between one more microwave frequencies resonant to the material.

78. The ammunition disabler of at least the embodiment 65 where the ammunition is one of a centerfire configuration or a rimfire configuration.

79. The ammunition disabler of at least the embodiment 65 where a second material is one or more of positioned within the material, integrated within the material, or positioned adjacent to the material.

80. The ammunition disabler of one or more of the embodiments 65-79 where a gap disrupts the mechanical link between the firing pin and the priming compound.

81. The ammunition disabler of one or more of the embodiments 65-80 where a microsphere structure is hollow and is filled with one or more of air, an inert gas, or a reactive gas.

82. The ammunition disabler of one or more of the embodiments 65-81 where the energy wave is in the frequency range of approximately $10^3$ Hz to $10^{14}$ Hz.

83. The ammunition disabler of one or more of the embodiments 65-82 where the energy wave is emitted from an energy wave generator positioned externally from the firearm and arranged to emit the energy wave through a protected space, wherein the material is changed from the operative state to the deactivated state when the material is located within the protected space.

84. The ammunition disabler of one or more of the embodiments 65-83 where the energy wave comprises an ultrasound wave produced by an ultrasound transducer.

85. The ammunition disabler of one or more of the embodiments 65-83 where the energy wave comprises an microwave produced by a magnetron.

86. The ammunition disabler of one or more of the embodiments 65-85 where a second energy wave generator is positioned to expand the protected space or provide a second protected space.

87. An ammunition disabler responsive to an energy wave for selectively disabling ammunition is provided, and generally comprises a grouping of microspheres, at least some of the microspheres selectively degradable from an operative state to a deactivated state upon exposure to the energy wave, the grouping of microspheres being positioned within the primer cup between the firing pin and the priming compound when the ammunition is chambered within the firearm; wherein, when the grouping of microspheres is in the operative state, the grouping of microspheres are capable of forming a mechanical link between the firing pin and the priming compound so that the percussion wave from the firing pin is transmitted through the grouping of microspheres to ignite the priming compound when the firing pin is activated; and wherein, when the grouping of microspheres is in the deactivated state, the degradation of one or more of the microspheres disrupts the mechanical link and inhibits transmission of the percussion wave through the grouping of microspheres to prevent ignition of the priming compound.

88. An ammunition disabling system is provided for selectively disabling ammunition operatively coupled to a material that is selectively changeable from an operative state to a deactivated state, in the operative state the material permits transmission of a percussive impact through the material for enabling firing of the ammunition, in the deactivated state the material inhibits transmission of the percussion wave through the material for preventing firing of the ammunition, the ammunition disabling system comprising: an energy wave generator having an energy wave source that emits an energy wave through the air to create a protected space, the energy wave being emitted at a frequency resonant a natural frequency of the material; wherein, when the ammunition is positioned within the protective space the material can be selectively exposed to the energy wave, and upon exposure to the energy wave, the energy wave induces a response in the material that results in a mechanical change of the material from the operative state to the deactivated state by degrading the mechanical structure of the material.

89. The ammunition disabler of embodiment 88 where the mechanical structure of the material degrades from the operative state to the deactivated state by continuous or pulsed exposure to the energy wave.

90. The ammunition disabler of one or more of the embodiments 88-89 where the energy wave comprising one or any combination of an ultrasound wave, a microwave, an infrasound wave, a long wave radio wave, a medium wave radio wave, a short wave radio wave, or a terahertz wave.

91. The ammunition disabler of one or more of the embodiments 88-89 where the energy wave source comprises an ultrasound transducer and the energy comprises an ultrasound wave, wherein the ultrasound transducer is a fixed frequency transducer or a variable frequency transducer.

92. The ammunition disabler of one or more of the embodiments 88-91 where an ultrasound frequency of the ultrasound wave is varied between one more ultrasound frequencies resonant to the material.

93. The ammunition disabler of one or more of the embodiments 88-89 where the energy wave source comprises a magnetron and the energy comprises a microwave.

94. The ammunition disabler of one or more of the embodiments 88-89, 93 where a microwave frequency of the microwave is varied between one more microwave frequencies resonant to the material.

95. The ammunition disabler of one or more of the embodiments 88-94 where a power output of the energy wave is sufficient to induce the response in the material over an air gap between the energy wave source and the material.

96. The ammunition disabler of one or more of the embodiments 88-95 where the frequency of the energy wave is in the range of $10^3$ Hz to $10^{14}$ Hz.

97. The ammunition disabler of one or more of the embodiments 88-96 where the energy wave induces a change in the material from the operative state to the deactivated state through one or more of a reduction in size of at least some of the material, a collapsing of at least some of the material, a fracturing of at least some of the material, an aggregation of at least some of the material, a sintering of at least some of the material, a bursting of at least some of the material, a chemical reaction in at least some of the material, or breakage of at least some of the material.

98. The ammunition disabler of one or more of the embodiments 88-97 where the system further comprises a second energy wave source that emits a second energy wave, the second energy wave being emitted at a second frequency matching the frequency of the energy wave or differing from the frequency of the energy wave.

99. The ammunition disabler of one or more of the embodiments 88-98 where a second energy wave generator comprises the second energy wave source, the second energy wave generator being positioned apart from the first energy wave generator.

100. The ammunition disabler of one or more of the embodiments 88-99 where the energy wave generator further comprises the second energy wave source, the energy wave source being directed in a first direction and the second energy wave source being directed in a second direction.

101. The ammunition disabler of one or more of the embodiments 88-100 where at least a portion of the energy wave generator oscillates to reorient the energy wave to change the protected space.

102. The ammunition disabler of one or more of the embodiments 88-101 where the portion of the energy wave generator reorients the energy wave through one or both of a linear path or an angular rotation.

103. The ammunition disabler of one or more of the embodiments 88-102 where the energy wave generator is one of a floor mounted system, a wall mounted system, a ceiling mounted system, a manned vehicle mounted system, an unmanned vehicle mounted system, a hand-held system, or a track mounted system.

104. The ammunition disabler of one or more of the embodiments 88-103 where the energy wave generator emits waves at multiple frequencies.

In closing, it is to be understood that although aspects of the present specification are highlighted by referring to specific embodiments, one skilled in the art will readily appreciate that these disclosed embodiments are only illustrative of the principles of the subject matter disclosed herein. Therefore, it should be understood that the disclosed subject matter is in no way limited to a particular compound, composition, article, apparatus, methodology, protocol, and/or reagent, etc., described herein, unless expressly stated as such. In addition, those of ordinary skill in the art will recognize that certain changes, modifications, permutations, alterations, additions, subtractions and sub-combinations thereof can be made in accordance with the teachings herein without departing from the spirit of the present specification. It is therefore intended that the following appended claims and claims hereafter introduced are interpreted to include all such changes, modifications, permutations, alterations, additions, subtractions and sub-combinations as are within their true spirit and scope.

Certain embodiments of the present invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. For instance, as mass spectrometry instruments can vary slightly in determining the mass of a given analyte, the term "about" in the context of the mass of an ion or the mass/charge ratio of an ion refers to +/−0.50 atomic mass unit. At the very least, and not as an attempt to limit the application of the doctrine of equivalents to the scope of the claims, each numerical indication should at least be construed in light of the number of reported significant digits and by applying ordinary rounding techniques.

Although the present material 80 has been described in the present specification and exemplary embodiments as being useful for disabling ammunition or primer by exposing the material 80 to an energy wave 124 emitted at a resonant or optimal frequency, power, pulse time, the present material may be used in any application where it is a desire to activate or deactivate, loosen or tighten, turn on or turn off, open or close, or to induce any change of the mechanical state of a mechanism (move, rotate, shift, and so on). For example, the present material 80 may be integrated, installed, or positioned on or in a valve mechanism, where the valve changes state (from open to closed or closed to open) due to exposure of the material 80 to an energy wave 124. In yet another alternate example, the present material 80 may be used with fasteners to release or tighten the fasteners (for example, in applications similar to existing shape memory fastener applications). Thus, the inventive material 80 is suitable for usage in many applications beyond the examples described in the present specification.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators such as "first," "second," "third," etc. for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples, or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising"

(and equivalent open-ended transitional phrases thereof like including, containing and having) encompasses all the expressly recited elements, limitations, steps and/or features alone or in combination with unrecited subject matter; the named elements, limitations and/or features are essential, but other unnamed elements, limitations and/or features may be added and still form a construct within the scope of the claim. Specific embodiments disclosed herein may be further limited in the claims using the closed-ended transitional phrases "consisting of" or "consisting essentially of" in lieu of or as an amended for "comprising." When used in the claims, whether as filed or added per amendment, the closed-ended transitional phrase "consisting of" excludes any element, limitation, step, or feature not expressly recited in the claims. The closed-ended transitional phrase "consisting essentially of" limits the scope of a claim to the expressly recited elements, limitations, steps and/or features and any other elements, limitations, steps and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps and/or features specifically recited in the claim whereas the meaning of the closed-ended transitional phrase "consisting essentially of" is being defined as only including those elements, limitations, steps and/or features specifically recited in the claim and those elements, limitations, steps and/or features that do not materially affect the basic and novel characteristic(s) of the claimed subject matter. Therefore, the open-ended transitional phrase "comprising" (and equivalent open-ended transitional phrases thereof) includes within its meaning, as a limiting case, claimed subject matter specified by the closed-ended transitional phrases "consisting of" or "consisting essentially of." As such embodiments described herein or so claimed with the phrase "comprising" are expressly or inherently unambiguously described, enabled and supported herein for the phrases "consisting essentially of" and "consisting of."

All patents, patent publications, and other publications referenced and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. Nothing in this regard should be construed as an admission that the inventors are not entitled to antedate such disclosure by virtue of prior invention or for any other reason. All statements as to the date or representation as to the contents of these documents is based on the information available to the applicants and does not constitute any admission as to the correctness of the dates or contents of these documents.

Lastly, the terminology used herein is for the purpose of describing particular embodiments only, and is not intended to limit the scope of the present invention, which is defined solely by the claims. Accordingly, the present invention is not limited to that precisely as shown and described.

What is claimed is:

1. An ammunition disabling system for selectively disabling ammunition operatively coupled to a material that is selectively changeable from an operative state to a deactivated state, in the operative state the material permits transmission of a percussive impact through the material for to strike a primer enabling firing of the ammunition, in the deactivated state the material inhibits transmission of the percussion impact through the material for preventing firing of the ammunition, the ammunition disabling system comprising:

an energy wave generator having an energy wave source that emits an energy wave through the air to create a protected space, the energy wave being emitted at a frequency tuned to induce a vibration of the material;

wherein, when the ammunition is positioned within the protective space, the material is exposed to the energy wave resulting in mechanical degradation of the material due at least in part to the vibration of the material, changing the material from the operative state to the deactivated state.

2. The ammunition disabling system of claim 1 wherein the material degrades from the operative state to the deactivated state by continuous, automatic pulsed, or periodic pulsed exposure to the energy wave.

3. The ammunition disabling system of claim 1 wherein the energy wave comprises one or any combination of an ultrasound wave, a microwave, an infrasound wave, a long wave radio wave, a medium wave radio wave, a short wave radio wave, or a terahertz wave.

4. The ammunition disabling system of claim 1 wherein the energy wave source comprises an ultrasound transducer and the energy wave comprises an ultrasound wave, wherein the ultrasound transducer is a fixed frequency transducer or a variable frequency transducer.

5. The ammunition disabling system of claim 4 wherein an ultrasound frequency of the ultrasound wave is varied between one or more ultrasound frequencies.

6. The ammunition disabling system of claim 1 wherein the energy wave source comprises a magnetron and the energy comprises a microwave.

7. The ammunition disabling system of claim 6 wherein a microwave frequency of the microwave is varied between one or more microwave frequencies.

8. The ammunition disabling system of claim 1 wherein a power output of the energy wave is sufficient to induce the vibration of the material over an air gap between the energy wave source and the material.

9. The ammunition disabling system of claim 1 wherein the frequency of the energy wave is in the range of $10^3$ Hz to $10^{14}$ Hz.

10. The ammunition disabling system of claim 1 wherein the energy wave induces a change in the material from the operative state to the deactivated state through one or more of a reduction in size of at least some of the material, a collapsing of at least some of the material, a fracturing of at least some of the material, an aggregation of at least some of the material, a sintering of at least some of the material, a bursting of at least some of the material, a chemical reaction in at least some of the material, or breakage of at least some of the material.

11. The ammunition disabling system of claim 1 further comprising a second energy wave source that emits a second energy wave, the second energy wave being emitted at a second frequency matching the frequency of the energy wave or differing from the frequency of the energy wave.

12. The ammunition disabling system of claim 11 wherein a second energy wave generator comprises the second energy wave source, the second energy wave generator being positioned apart from the first energy wave generator.

13. The ammunition disabling system of claim 11 wherein the energy wave generator further comprises the second energy wave source, the energy wave source being directed in a first direction and the second energy wave source being directed in a second direction.

14. The ammunition disabling system of claim 1 wherein the energy wave generator reorients the energy wave to change the protected space.

15. The ammunition disabling system of claim 14 wherein the portion of the energy wave generator reorients the energy wave by oscillating through one or both of a linear path or an angular rotation.

16. The ammunition disabling system of claim 1 wherein the energy wave generator is one of a floor mounted system, a wall mounted system, a ceiling mounted system, a manned vehicle mounted system, an unmanned vehicle mounted system, a hand-held system, or a track mounted system.

17. The ammunition disabling system of claim 1 wherein the energy wave generator emits waves at multiple frequencies.

18. The ammunition disabling system of claim 1 wherein the energy wave is emitted at a frequency resonant to a natural frequency of the material.

19. The ammunition disabling system of claim 1 further comprising a second energy wave source that emits a second energy wave, the second energy wave being emitted at a second frequency matching the frequency of the energy wave or differing from the frequency of the energy wave.

20. The ammunition disabling system of claim 1 wherein mechanical degradation of the material due at least in part to the vibration of the material causing one or more of an acoustic cavitation, a piezoelectric effect, and a heat generation in the material.

21. An ammunition disabling system for selectively disabling ammunition operatively coupled to a material that is selectively changeable from an operative state to a deactivated state, in the operative state the material permits transmission of a percussive impact through the material to strike a primer for enabling firing of the ammunition, in the deactivated state the material inhibits transmission of the percussion impact through the material for preventing firing of the ammunition, the ammunition disabling system comprising:

an energy wave generator having an energy wave source that emits an energy wave through the air to create a protected space, the energy wave being emitted at a frequency tuned to induce a vibration resonant a natural frequency of the material when in the protected space causing the material to mechanically degrade from the operative state to the to the deactivated state due at least in part to the vibration; and a second energy wave source that emits a second energy wave wherein, when the ammunition is positioned within the protective space the material can be selectively exposed to the energy wave, and upon exposure to the energy wave, the energy wave induces a response in the material that mechanically changes the material from the operative state to the deactivated state by degrading the mechanical structure of the material.

22. The ammunition disabling system of claim 21 wherein the second energy wave being emitted at a second frequency either matching the frequency of the energy wave or differing from the frequency of the energy wave.

23. The ammunition disabling system of claim 21 wherein a second energy wave generator comprises the second energy wave source, the second energy wave generator being positioned apart from the first energy wave generator.

24. The ammunition disabling system of claim 21 wherein the energy wave is emitted at a frequency resonant to a natural frequency of the material.

25. An ammunition disabling system for selectively disabling ammunition operatively coupled to a material that is selectively changeable from an operative state to a deactivated state, in the operative state the material permits transmission of a percussive impact through the material to strike a primer for enabling firing of the ammunition, in the deactivated state the material does not permit the transmission of the percussive impact through the material for disabling firing of the ammunition the ammunition disabling system comprising:

an energy wave generator having an energy wave source that emits an energy wave at one or more frequencies through the air to create a protected space, the energy wave acting on the material and causing a physical change in the material when in the protected space causing the material to mechanically degrade from the operative state to the to the deactivated state.

26. The ammunition disabling system of claim 25 wherein the energy wave is emitted at a frequency resonant to a natural frequency of the material.

27. The ammunition disabling system of claim 25 wherein mechanical degradation of the material due at least in part to a vibration of the material.

28. The ammunition disabling system of claim 25 wherein the energy wave induces a change in the material from the operative state to the deactivated state through one or more of a reduction in size of at least some of the material, a collapsing of at least some of the material, a fracturing of at least some of the material, an aggregation of at least some of the material, a sintering of at least some of the material, a bursting of at least some of the material, a chemical reaction in at least some of the material, or breakage of at least some of the material.

29. The ammunition disabling system of claim 25 wherein mechanical degradation of the material due at least in part to a vibration of the material causing one or more of an acoustic cavitation, a piezoelectric effect, and a heat generation in the material.

* * * * *